US008292107B1

(12) United States Patent
Hong

(10) Patent No.: US 8,292,107 B1
(45) Date of Patent: Oct. 23, 2012

(54) FOLDING CONTAINER

(75) Inventor: Jung Sun Hong, Gimpo-si (KR)

(73) Assignees: Jung Sun Hong, Gimpo-Si (KR); Korea Container Pool Co., Ltd., Seoul (KR)

( * ) Notice: Subject to any disclaimer, the term of this patent is extended or adjusted under 35 U.S.C. 154(b) by 0 days.

(21) Appl. No.: 13/260,370

(22) PCT Filed: Sep. 2, 2011

(86) PCT No.: PCT/KR2011/006510

§ 371 (c)(1),
(2), (4) Date: Sep. 25, 2011

(30) Foreign Application Priority Data

Jul. 22, 2011 (KR) ..... 10-2011-0072735
Aug. 12, 2011 (KR) ..... 20-2011-0007333

(51) Int. Cl.
*B65D 88/52* (2006.01)

(52) U.S. Cl. ..... 220/7; 220/1.5; 220/4.28

(58) Field of Classification Search ..... 220/4.28, 220/4.29, 6, 1.5, 7, 4.33, 682, 677; 206/600, 206/386, 577
See application file for complete search history.

(56) References Cited

U.S. PATENT DOCUMENTS

| | | | | |
|---|---|---|---|---|
| 844,955 | A * | 2/1907 | Morgan | 220/7 |
| 1,007,035 | A * | 10/1911 | Kohout | 220/7 |
| 3,398,850 | A * | 8/1968 | Kennard | 220/6 |
| 3,612,330 | A * | 10/1971 | Baer | 220/1.5 |
| 2008/0135545 | A1 * | 6/2008 | Sadkin et al. | 220/1.5 |
| 2009/0078700 | A1 * | 3/2009 | Boivin | 220/4.28 |
| 2012/0061390 | A1 * | 3/2012 | Giesbers | 220/7 |

* cited by examiner

*Primary Examiner* — Andrew Perreault
(74) *Attorney, Agent, or Firm* — Lexyoume IP Meister, PLLC.

(57) ABSTRACT

Disclosed herein is a folding container which stores various kinds of cargo and is transported. A container body of the folding container includes a top plate, a bottom plate, left and right side plates, and front and rear end plates. Each side plate includes upper and lower plate bodies which are connected to each other and to the top and bottom plates by spring hinges. A rotating shaft is provided in the container body, and a belt connected to the rotating shaft is connected to the left and right side plates at positions adjacent to the junctions between the upper and lower plate bodies. The left and right side plates are pulled inwards and folded by rotating the rotating shaft and winding the belt around the rotating shaft. Therefore, the operation of folding or unfolding the container body can be facilitated, and safety can be ensured during the operation.

19 Claims, 15 Drawing Sheets

FOLDING CONTAINER

BACKGROUND OF THE INVENTION

1. Field of the Invention

The present invention relates generally to containers which store various kinds of cargo therein and are transported by ships or the like and, more particularly, to a folding container which is configured such that a small number of workers can easily fold or unfold a container body using a folding means so that it is convenient to handle the container and the use of space is optimized, and which has a superior durability and is able to be safely used, because the container body can be reliably maintained in the folded or unfolded state.

2. Description of the Related Art

Generally, containers are used to transport various kinds of cargo by ships or the like, for example when exporting or importing for trade purposes.

In the conventional art, such a container has a rectangular box shape.

In the case of the conventional container, even when it contains nothing, the empty container must be transported in the shape of a rectangular box. Therefore, the rate of use of space is low, thus increasing distribution costs.

To overcome the above problems, several folding containers have been proposed that can be stored and transported in the folded state when empty.

Particularly, in Korean Patent Registration No. 10-638570 which was filed by the applicant of the present invention, a folding container includes a container body which defines a loading space therein. The container body includes a top plate, a bottom plate, left and right side plates, and front and rear end plates. The left and right side plates are vertically provided at opposite sides between the top plate and the bottom plate. Each of the left and right side plates includes upper and lower plate bodies. The upper and lower plate bodies of the left and right side plates are connected to each other and to the top and bottom plates in the longitudinal direction of the container by spring hinges which are provided on an outer portion between the upper and lower plate bodies and on inner portions of upper and lower ends of the upper and lower plate bodies. Thereby, the upper and lower plate bodies can be folded inwards in such a way to face each other. The front and rear end plates are respectively coupled to the front and rear edges of the bottom plate by bottom hinges so as to be rotatable and foldable inwards or outwards. Furthermore, the top plate and the upper plate bodies of the left and right side plates, the bottom plate and the lower plate bodies of the left and right side plates, and the top plate and the front and rear end plates are locked to or unlocked from each other by catch clamps. Each catch clamp includes a clamp part and a latch which are respectively disposed at corresponding positions facing each other. The clamp part includes a locking hook which is provided so as to be rotatable around a shaft so that the locking hook is releasably locked to the latch.

In the technique disclosed in the registered patent mentioned above, when the container body contains nothing, the front and rear end plates of the container body can be folded inwards and the upper and lower plate bodies of the left and right side plates can be folded inwards in such a way as to face to each other. The container body is stored and transported in this state thus enhancing a rate of use of space, and thereby reducing distribution costs.

However, this technique developed by the applicant of the present invention has the following problems.

First, to elastically unfold the upper and lower plate bodies of the left and right side plates of the container body which have been in the folded state, the elastic force of the spring hinges must be sufficiently high. However, when the elastic force of the spring hinges is high, it becomes very difficult to fold the upper and lower plate bodies of the left and right side plates due to the high elastic force of the spring hinges.

In particular, because the folding operation is manually performed by workers, it is very difficult for a small number of workers to fold the container body, thus increasing safety concerns.

Secondly, the top plate, the left and right side plates and the bottom plate of the container body are connected and fastened to each other only by spring hinges. Considering the fact that corner castings provided on the respective corners of the top plate are held, lifted and moved by a container handling machine, the durability of the container body is reduced with respect to the vertical or horizontal direction.

Particularly, the spring hinges have the same structure, and each spring hinge has only one torsion coil spring. Thus, the elastic force of each spring hinge is not sufficient. Therefore, a comparatively large number of spring hinges are required to smoothly unfold the container body. Furthermore, the springs hinges that rotate to 90° and are installed between the top plate and the upper plate bodies of the left and right side plates and between the bottom plate and the lower plate bodies of the left and right side plates have the same structure as that of the spring hinges that rotate to 180° and are installed between the upper and lower plate bodies of the left and right side plates. Thus, a portion where the elastic durability of the torsion spring of the spring hinge weakens may occur.

Third, in each spring hinge, the legs of each torsion coil spring protrude upwards and downwards from the surface of the spring hinge body. Thus, to prevent the legs from interfering with other elements, grooves are formed in upper and lower portions of the spring hinge body, and the legs of the torsion coil spring are seated into the corresponding grooves. However, because the torsion coil spring is twisted when the container body is folded, the legs of the torsion coil spring must move in the longitudinal direction of the spring, but the legs of the torsion coil spring cannot move. Thus, a load applied to the torsion coil spring is increased, thus reducing the durability of the spring hinge.

Fourth, after the top plate, the left and right side plates and the bottom plate of the container body are folded, and double locking hooks of the catch clamps that are disposed on the bottom plate are locked to latches of the corresponding catch clamps that are disposed on the top plate, thus maintaining the container body in the folded state. In this state, when unlocking the double locking hooks to unfold the container body, because the top plate and the left and right side plates are elastically biased upwards by the elastic force of the spring hinges, it is very difficult to remove the double locking hooks from the latches.

Fifth, the double locking hook of each catch clamp comprises two typical locking hooks which are connected to each other. The double locking hook is elastically biased upwards by the elastic force of a coil spring to prevent the double locking hook from hanging down to come into contact with the ground. Rather, the double locking hook may be bent and inserted between the left and right side plates, thus impeding the folding of the container body.

Sixth, when a first one of the left and right side plates of the container body which has been folded is unfolded after a second one of them is vertically unfolded, the second side plate may be bent towards the first side plate rather than being maintained in the vertical state, and the first side plate and the top plate may lean towards a worker, thus endangering the safety of the worker.

Seventh, the top plate, the left and right side plates, and the bottom plate of the container body slope relative to each other at predetermined angles to prevent rainwater from entering the container body. However, because the junctions between the top plate, the left and right side plates and the bottom plate of the container body have no sealing structure, the ability to seal the container body is markedly low.

To solve the above-mentioned problems, the applicant of the present invention worked hard to apply various improvements to the defective parts of the conventional technique developed by the applicant of the present invention and thus developed a folding container whose quality has been enhanced.

SUMMARY OF THE INVENTION

Accordingly, the present invention has been made keeping in mind the above problems occurring in the prior art, and an object of the present invention is to provide a folding container which stores various kinds of cargo therein and is transported by a ship or the like, wherein a small number of workers can easily fold or unfold the container body using a folding means so that it is convenient to handle the container and the use of space is optimized, and which has superior durability and is able to be safely used, because the container body can be reliably maintained in the folded or unfolded state.

Another object of the present invention is to provide a folding container in which a top plate, left and right side plates, and a bottom plate of the container body are connected to each other not only by spring hinges but also by connection brackets after they have been vertically unfolded, so that the durability of the container body in the vertical or horizontal directions can be markedly enhanced even when corner castings provided on the respective corners of the top plate are held, lifted and moved by a container handling machine to move the container body.

A further object of the present invention is to provide a folding container in which the cross-sectional structure of the spring wire is improved and the number of torsion coil springs of the spring hinges or the number of turns of the wire of each torsion coil spring is changed depending on the load applied thereto, for example, those of the spring hinges that rotate to 180° and are installed between the upper and lower plate bodies of the left and right side plates are greater than those of the springs hinges that rotate to 90° and are installed between the top plate and the upper plate bodies of the left and right side plates and between the bottom plate and the lower plate bodies of the left and right side plates, whereby the number of torsion coil springs can be increased compared to that of the conventional technique, so that the durability of the container body is enhanced, and the container body can be more easily unfolded by the increased elastic force of the spring hinges.

Yet another object of the present invention is to provide a folding container in which each spring hinge has a guide depression so that when each torsion coil spring is twisted, the axial movement of opposite legs of the torsion coil spring is guided by the guide depression, and the opposite legs are prevented from protruding outside the spring hinge, thus enhancing the operating efficiency and the durability of the container.

Still another object of the present invention is to provide a folding container in which from the state in which double locking hooks of the catch clamps disposed on the bottom are locked to corresponding latches disposed on the top plate to maintain the container body in the folded state, the top and bottom plates are connected to each other by separate holding bars before the double locking hooks of the catch clamps are unlocked from the latches, so that the operation of unlocking the double locking hook from the latches can be facilitated regardless of the elastic force of the spring hinges, and in which each double locking hook of the catch clamps is supported by a separate support pin to restrain the double locking hook from rotating upwards or downwards, so that unlike the conventional technique, the double locking hook is prevented from being caught between the corresponding side plate or the lower end of the latch of the side plate and the bottom plate, thus making the operation of folding the left and right side plates smooth.

Still another object of the present invention is to provide a folding container in which when a first one of the left and right side plates of the container body which has been folded is unfolded after a second one of them is vertically unfolded, the second side plate is maintained in the vertical unfolded state by the catch clamps and the connection brackets that belong to the second side plate so that the second side plate which has been in a vertically unfolded state is prevented from bending and becoming inclined towards the first side plate, and the first side plate is prevented from leaning towards a worker, thus facilitating the unfolding operation and enhancing safety.

Still another object of the present invention is to provide a folding container in which a silicone packing is installed in the junctions between the top plate, the bottom plate and the upper and lower plate bodies of the left and right side plates, thus enhancing the sealing ability to prevent water from coming in.

Still another object of the present invention is to provide a folding container in which guide surfaces are formed on the front and rear end plates of the container body to guide the entrance of vehicles when loading the vehicles into the container body, thus facilitating the operation of loading the vehicle, and in which a separate door is provided on each of the left and right side plates so that a worker can easily enter the container body.

In order to accomplish the above object, the present invention provides a folding container, including: a container body defining a loading space therein, the container body including, a top plate, a bottom plate, left and right side plates vertically provided at opposite sides between the top plate and the bottom plate, each of the left and right side plates comprising upper and lower plate bodies connected to each other and to the top and bottom plates in a longitudinal direction of the container body by spring hinges provided both on an outer portion between the upper and lower plate bodies and on inner portions of upper and lower ends of the upper and lower plate bodies so that the upper and lower plate bodies are foldable inwards in such a way to face each other, and front and rear end plates respectively coupled to front and rear edges of the bottom plate by bottom hinges so as to be rotatable and foldable inwards or outwards; at least one catch clamp provided on each of junctions between the top plate and the upper plate bodies of the left and right side plates, between the bottom plate and the lower plate bodies of the left and right side plates, and between the top plate and the front and rear end plates to releasably lock the associated pair of elements to each other, the catch clamp including a clamp part and a latch disposed at corresponding positions facing each other, the clamp part having a locking hook provided so as to be rotatable around a shaft so that the locking hook is releasably locked to the latch; and a side plate folding means including a rotating shaft rotatably installed in the container body in the longitudinal direction of the container body, the rotating shaft being connected to the junction of the upper or lower side plates of the left and right side plates by a belt so that, when the rotating shaft rotates to wind the belt around the rotating shaft, the upper and lower plate bodies of the left and right side plates are pulled inwards and folded.

The rotating shaft of the side plate folding means may comprise a rotating shaft rotatably installed at a central portion of a ceiling in the container body in the longitudinal direction of the container body, wherein first ends of left and right belts are wound around the rotating shaft in opposite directions, and second ends of the left and right belts are respectively connected to the left and right side plates at the junctions between the upper and lower plate bodies, whereby when the rotating shaft rotates to simultaneously wind the left and right belts around the rotating shaft, medial portions of the left and right side plates are simultaneously pulled inwards and folded.

The rotating shaft of the side plate folding means may comprise a rotating shaft rotatably installed at a central portion of a bottom in the container body in the longitudinal direction of the container body, wherein first ends of left and right belts are wound around the rotating shaft in opposite directions, and second ends of the left and right belts are respectively connected to the left and right side plates at the junctions between the upper and lower plate bodies, whereby when the rotating shaft rotates to simultaneously wind the left and right belts around the rotating shaft, medial portions of the left and right side plates are simultaneously pulled inwards and folded.

The rotating shaft of the side plate folding means may comprise rotating shafts respectively and rotatably installed at both sides of an upper or lower portion in the container body in the longitudinal direction of the container body, wherein first ends of left and right belts are respectively connected to the rotating shafts, and each of second ends of the left and right belts is connected to an opposite one of the left and right side plates at the junction between the upper and lower plate bodies of the corresponding side plate in such a way that the left and right belts form an "X" shape, whereby when the rotating shafts rotate to wind the left and right belts around the corresponding rotating shafts, medial portions of the left and right side plates are pulled inwards and folded.

The rotating shaft of the side plate folding means may comprise rotating shafts respectively and rotatably installed at upper or lower portions of both sidewalls in the container body in the longitudinal direction of the container body, wherein first ends of left and right belts are connected to the respective rotating shafts, and each of second ends of the left and right belts is connected to an opposite one of the left and right side plates at the junction between the upper and lower plate bodies of the corresponding side plate in such a way that the left and right belts form an "X" shape, whereby when the rotating shafts rotate to wind the left and right belts around the corresponding rotating shafts, medial portions of the left and right side plates are pulled inwards and folded.

The rotating shaft of the side plate folding means may comprise a rotating shaft rotatably installed at an upper or lower portion of one sidewall in the container body in the longitudinal direction of the container body, wherein a first end of the belt is connected to the rotating shaft, and a second end of the belt is horizontally connected to the left or right side plate that is opposite to the rotating shaft, whereby when the rotating shaft rotates to wind the belt around the rotating shaft, the medial portions of the left and right side plates are pulled inwards and folded.

The side plate folding means may include: a ratchet gear fitted over the rotating shaft; a ratchet pawl provided at a predetermined position adjacent to the ratchet gear so as to be rotatable around a hinge, the ratchet pawl being elastically brought into contact with the ratchet gear by a compression spring so that the ratchet gear is releasably locked to the ratchet pawl; and a stopper disposed at a predetermined position adjacent to the ratchet pawl, the stopper retractably protruding to selectively support the ratchet pawl so that the ratchet gear is selectively maintained in a state of being unlocked from the ratchet pawl to allow the belt to be selectively unwound from the rotating shaft.

Furthermore, a spool may be fitted over and fastened to the rotating shaft by a key so that the belt is wound around the spool.

In addition, a polygonal protrusion may be provided on an end of the rotating shaft and be inserted into a through hole formed in the container body such that the polygonal protrusion extends outside the container body through the through hole, wherein a ratchet handle having a wrench hole is connected to the rotating shaft in such a way that the polygonal protrusion is inserted into the wrench hole so that the rotating shaft is able to be rotated by rotating the ratchet handle outside the container body.

Preferably, a reverse U-shaped hook may be connected to the second end of the belt, and a catch rod may be provided in the corresponding side plate at a position adjacent to the junction between the upper and lower plate bodies of the side plate so that the reverse U-shaped hook of the belt is removably hooked to the catch rod.

Each of the spring hinges may include upper and lower mounting pieces rotatably coupled to each other by a shaft pin over which at least one torsion coil spring is fitted, wherein guide depressions are respectively formed in outer surfaces of the mounting pieces in such a way as to face each other so that opposite legs of the torsion coil spring are seated into and guided by the guide depressions to prevent the legs from protruding outside the mounting pieces when the legs are moved in an axial direction by torsion of the torsion coil spring.

Each of the spring hinges may be configured such that a number of torsion coil springs is different depending on a load applied to the spring hinge, wherein a number of torsion springs of each of the spring hinges that rotate up to 180° and are installed between the upper and lower plate bodies of the left and right side plates is greater than a number of torsion springs of each of the springs hinges that rotate up to 90° and which are installed between the top plate and the upper plate bodies of the left and right side plates and between the bottom plate and the lower plate bodies of the left and right side plates.

Each of the spring hinges may be configured such that a number of turns of a wire of each torsion coil spring is changed depending on a load applied to the spring hinge, wherein a number of turns of the wire of each torsion coil spring of the spring hinges that rotate up to 180° and which are installed between the upper and lower plate bodies of the left and right side plates is greater than a number of turns of each torsion coil spring of the springs hinges that rotate up to 90° and which are installed between the top plate and the upper plate bodies of the left and right side plates and between the bottom plate and the lower plate bodies of the left and right side plates.

The wire of each torsion coil spring of the spring hinges may be configured such that a cross-section thereof has an elliptical shape that has a vertical major axis and is reduced in a diameter with respect to a longitudinal direction of the torsion coil spring so that the spring hinge is compact in the longitudinal direction of the torsion coil spring.

The folding container may further include a plurality of side plate support units, each of the side plate support units including: a connection bracket provided on each of front and rear ends of the junctions between the top plate and the upper plate bodies of the left and right side plates, between the upper and lower plate bodies of the left and right side plates, and between the bottom plate and the lower plate bodies of the left and right side plates, the connection bracket being fastened at a first end thereof to one of the associated pair of elements; and a fastening bar installed in a remaining one of the associated pair of elements, the fastening bar being elastically and removably inserted into a support hole formed in a second end of the connection bracket, wherein the fastening bar is installed in a bar housing, having a guide slot extending in a longitudinal direction of the bar housing, and a locking slot extending from a rear end of the guide slot in a circumferential direction, and a protrusion handle is provided on a predetermined portion of the fastening bar and elastically moves along the guide slot or the locking slot so that the fastening bar is inserted into the support hole of the connection bracket to support the connection bracket and to prevent the left and right side plates from being folded or is removed from the support hole to release the connection bracket.

The folding container may further include a plurality of holding bars provided on the front and rear ends of the bottom plate below the corresponding connection brackets, each of the holding bars having: a hinge pin provided on an upper portion of the holding bar so that the holding bar rotates around the hinge pin and is elastically extracted from or retracted into the bottom plate; and a fastening pin protruding inwards from a lower end of the holding bar so that when the container body is folded, the fastening pin is inserted into the support hole of the connection bracket fastened to the top plate to maintain the container body in the folded state.

Of the catch clamps disposed on the lower ends of the left and right side plates of the container body, the clamp part of each of at least catch clamps that are disposed at opposite ends of the left and right side plates may include a double locking hook comprising first and second locking hooks rotatably connected to each other by a connection ring, the first and second locking hooks being selectively locked to the latch that is provided on the lower plate body of the corresponding side plate or locked to the latch that is provided on the top plate when the container body is folded, wherein the first locking hook of the double locking hook is elastically biased upwards by a torsion spring to prevent the double locking hook from hanging down and making contact with a ground, and a support pin is retractably extracted from one side of the clamp part to restrict the elastic upward rotation of the double locking hook so that the double locking hook is prevented from coming into contact with a lower portion of the corresponding latch of the side plate, thus preventing folding of the side plate onto the bottom plate from being impeded.

Of the catch clamps disposed on the lower ends of the left and right side plates of the container body, the clamp part of each of at least catch clamps that are disposed at opposite ends of the left and right side plates may include upper and lower locking hooks connected at opposite ends thereof to each other by coil springs, the locking hooks being connected to each other in such a way that the opposite ends thereof pass through the corresponding coil springs and are locked to the corresponding opposite ends of the coil springs, whereby, when a first one of the left and right side plates is unfolded after a second one of the left and right side plates has been vertically unfolded, the coil springs elastically support the unfolded second side plate such that the second side plate is prevented from bending towards the first side plate at a junction between the second side plate and the bottom plate.

Furthermore, a seating groove may be formed in a perimeter of each of contact surfaces between the top plate, the upper and lower plate bodies of the left and right side plates and the bottom plate, and a silicone packing may be seated into the seating groove to ensure a seal therebetween.

In addition, a guide surface having an entrance ramp at an outer side thereof may be formed on each of opposite ends of inner surfaces of the front and rear end plates so that when vehicles are loaded into the container body, the vehicles enter the container body along the guide surfaces.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
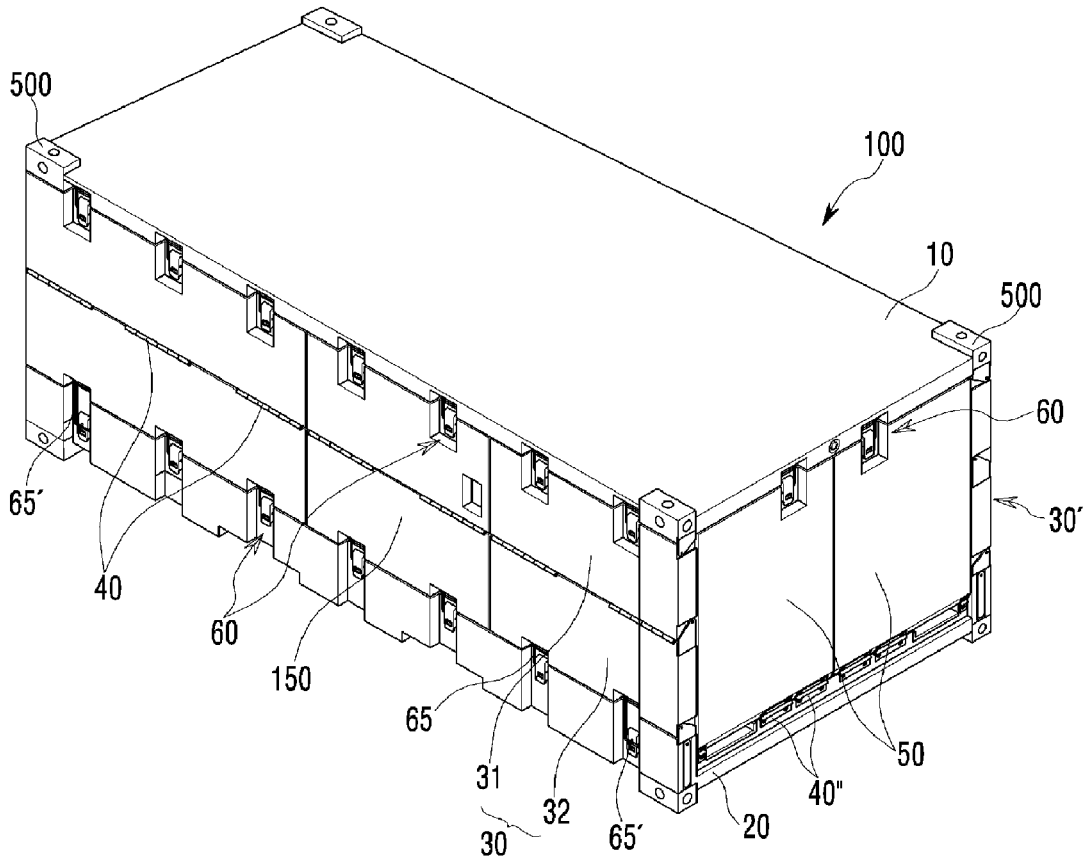
FIG. 1 is a perspective view showing the external appearance of a folding container, according to the present invention.
Figure 2:
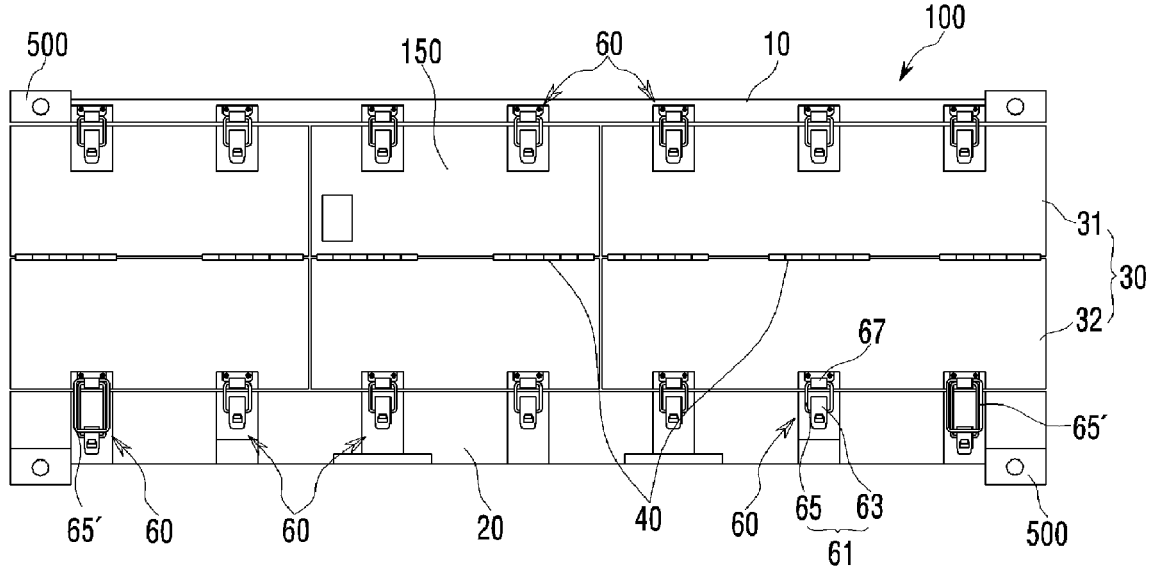
FIG. 2 is a left side view of the folding container according to the present invention.
Figure 3:
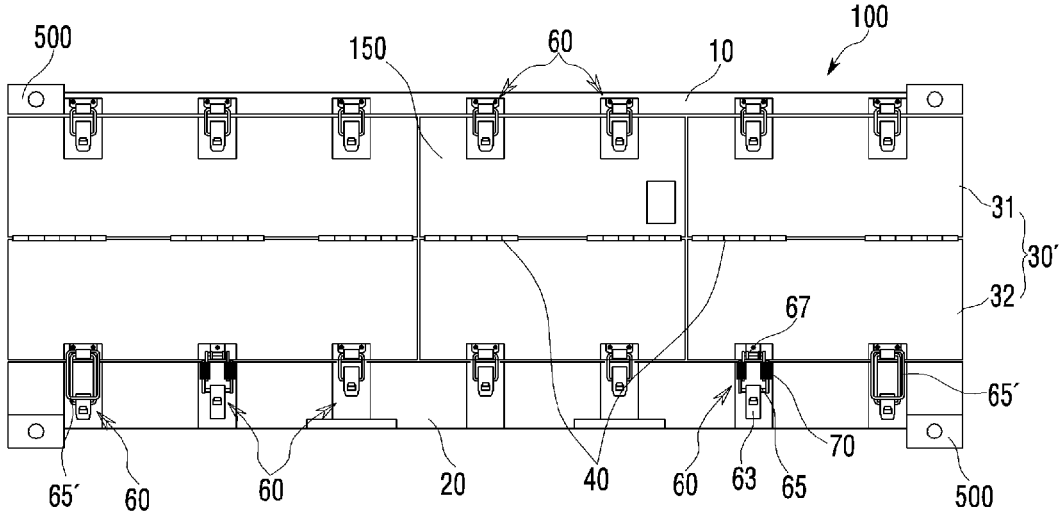
FIG. 3 is a right side view of the folding container according to the present invention.
Figure 4:
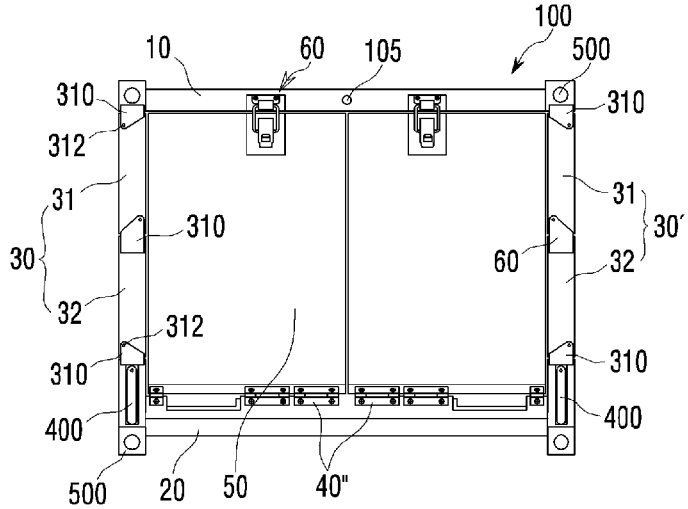
FIG. 4 is a front view of the folding container according to the present invention.
Figure 5:
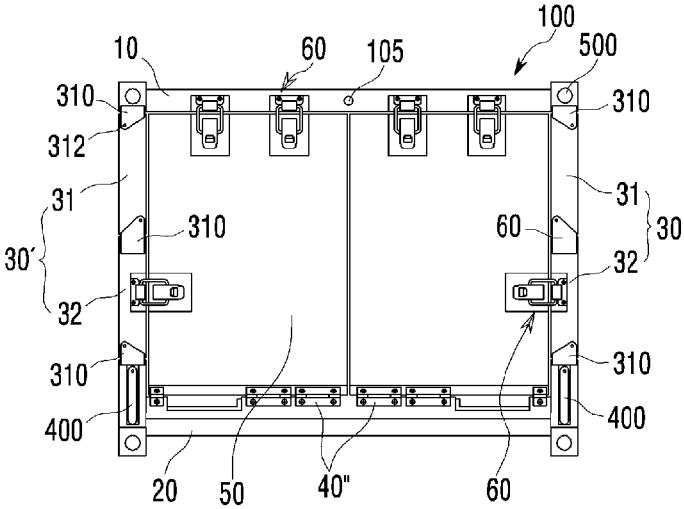
FIG. 5 is a rear view of the folding container according to the present invention.
Figure 6:
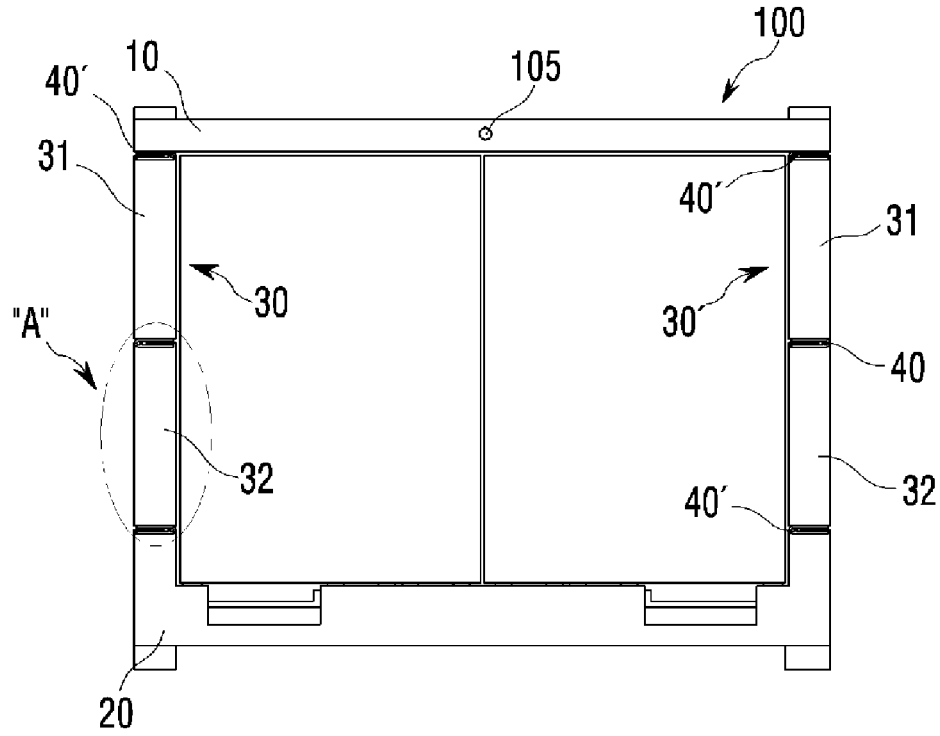
FIG. 6 is a front sectional view of the folding container according to the present invention.
Figure 7:
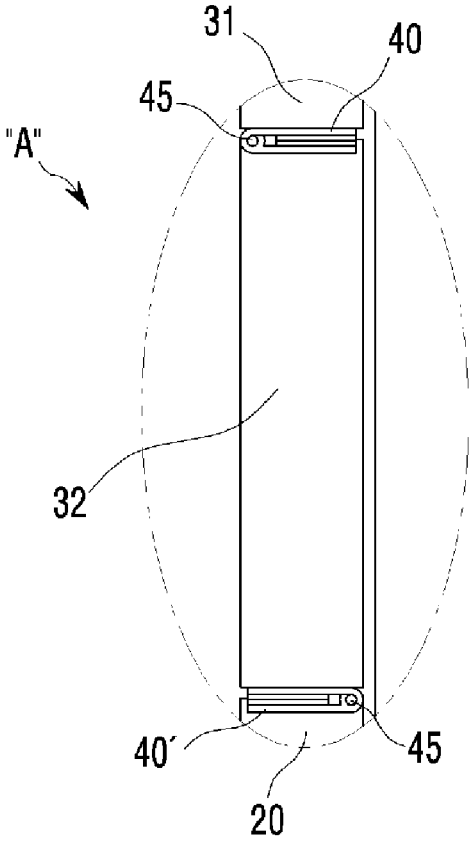
FIG. 7 is an enlarged view of a circled portion "A" of FIG. 6.
Figure 8:
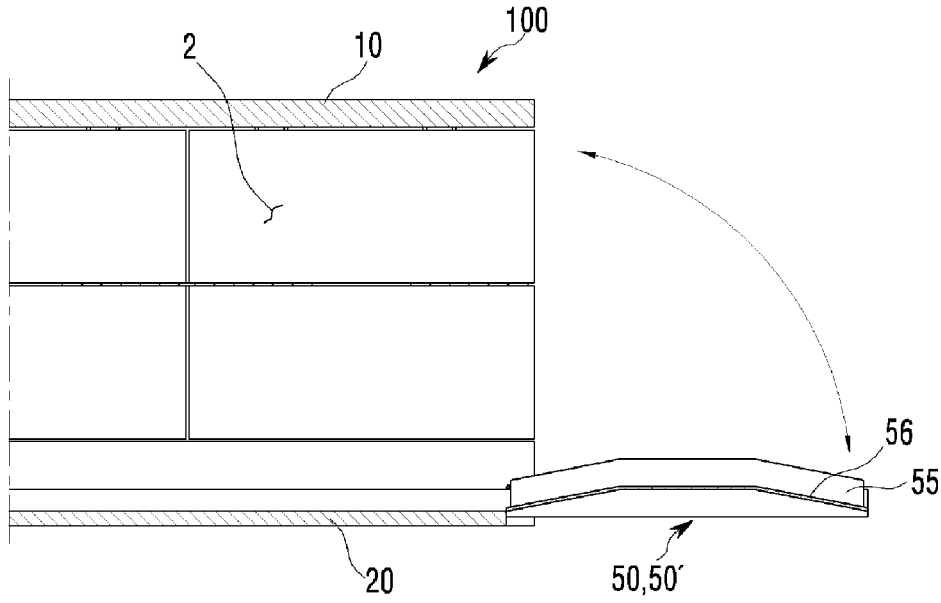
FIG. 8 is a sectional view showing a portion of the folding container according to the present invention.

Hereinafter, a preferred embodiment of the present invention will be described in detail with reference to the attached drawings.

As shown in FIGS. 1 through 38, a folding container according to the present invention includes a container body 100 which defines a loading space 2 therein. The container body 100 includes a top plate 10, a bottom plate 20, left and right side plates 30 and 30', and front and rear end plates 50 and 50'. The left and right side plates 30 and 30' are vertically provided at opposite sides between the top plate 10 and the bottom plate 20. Each of the left and right side plates 30 and 30' includes upper and lower plate bodies 31 and 32. The upper and lower plate bodies 31 and 32 of the left and right side plates 30 and 30' are connected to each other and to the top and bottom plates 10 and 20 in the longitudinal direction of the container by spring hinges 40 and 40' which are provided on an outer portion between the upper and lower plate bodies 31 and 32 and on inner portions of upper and lower ends of the upper and lower plate bodies 31 and 32. Thereby, the upper and lower plate bodies 31 and 32 can be folded inwards in such a way to face each other. The front and rear end plates 50 and 50' are respectively coupled to the front and rear edges of the bottom plate 20 by bottom hinges 40" so as to be rotatable and foldable inwards or outwards. Furthermore, the folding container according to the present invention further includes at least one catch clamp 60 which is provided on each of the junctions between the top plate 10 and the upper plate bodies 31 of the left and right side plates 10 and 20, between the bottom plate 20 and the lower plate bodies 32 of the left and right side plates 10 and 20, and between the top plate 10 and the front and rear end plates 50 and 50' to releasably lock to the associated pair of elements. The catch clamp 60 includes a clamp part 61 and a latch 67 which are respectively disposed at corresponding positions facing each other. The clamp part 61 includes a locking hook which is provided so as to be rotatable around a shaft so that the locking hook is releasably locked to the latch 67 to releasably lock the associated pair of elements to each other.

The catch clamp part 61 of the catch clamp 60 includes a mounting plate 62, a clamp body 63 which is hinged to the mounting plate 62, a lock 64 which is elastically locked to a rectangular hole 63*a* of the clamp body 63, and the locking hook 65 which is pivotally coupled to one end of the clamp body 63.

Particularly, the present invention further includes a side plate folding means 200. The side plate folding means 200 includes a rotating shaft 210 and is rotatably installed in the container body 100 in the longitudinal direction of the folding container. The rotating shaft 210 is connected to the upper or lower side plates 31 or 32 of the left and right side plates 30 and 30' by a belt so that, when the rotating shaft 210 rotates to wind the belt around the rotating shaft 210, the upper and lower plate bodies 31 and 32 of the left and right side plates 30 and 30' are pulled inwards and folded.

In the present invention, the side plate folding means 200 can be embodied in various different manners. Embodiments of the side plate folding means 200 are classified into a structure in which the left and right side plates 30 and 30' are simultaneously folded, and a structure in which the left and right side plates 30 and 30' are individually folded.

Figure 11:
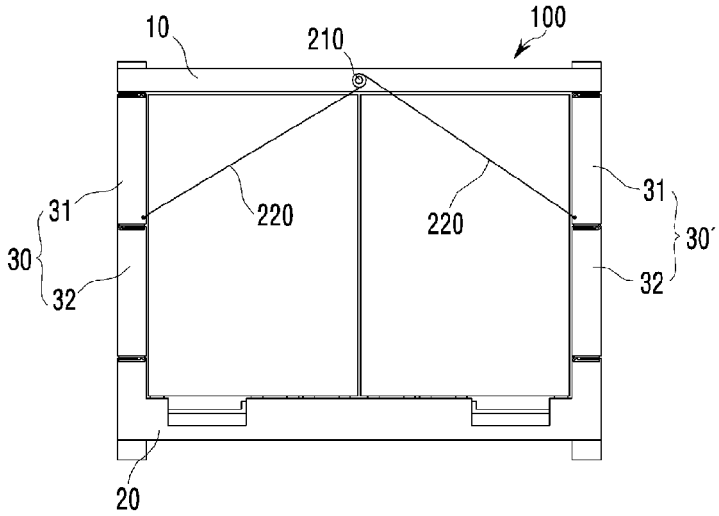
FIGS. 11 through 18 are front views showing various embodiments of the installation of a rotating shaft according to the present invention.
Figure 12:
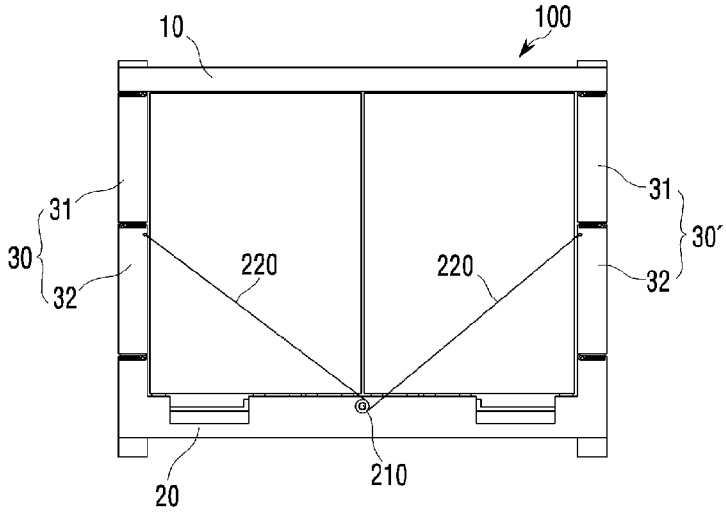

In an embodiment of the side plate folding means 200, as shown in FIGS. 11 and 12, a rotating shaft 210 is rotatably installed at the central portion of the ceiling or the bottom in the container body 100 in the longitudinal direction of the container. First ends of left and right belts 220 are wound around the rotating shaft 210 in opposite directions. Second ends of the left and right belts 220 are respectively connected to the left and right side plates 30 and 30' at the junctions between the upper and lower plate bodies 31 and 32. Thus, when the rotating shaft 210 rotates to wind the left and right belts 220 around the rotating shaft 210 at the same time, the left and right side plates 30 and 30' are simultaneously pulled inwards and folded.

Figure 13:
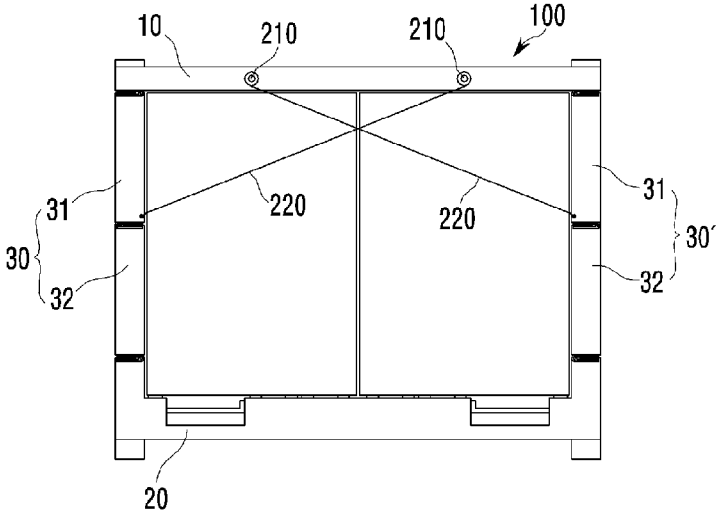
Figure 14:
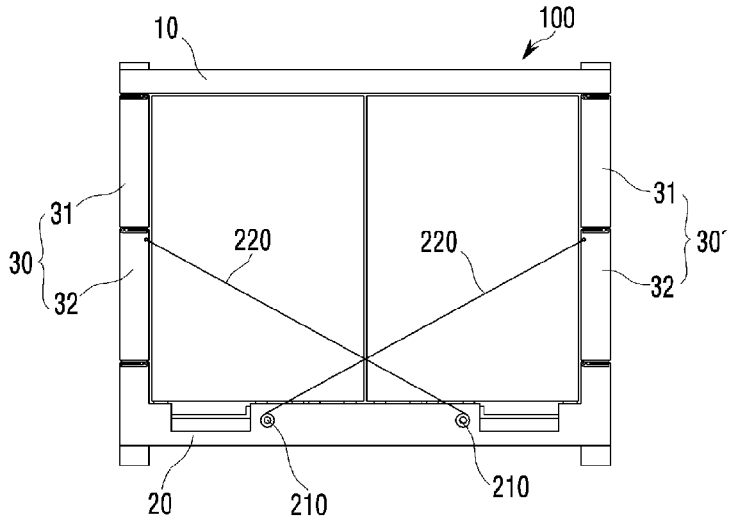

In another embodiment of the side plate folding means 200, as shown in FIGS. 13 and 14, rotating shafts 210 are respectively and rotatably installed at both sides of an upper or lower portion in the container body 100 in the longitudinal direction of the container. First ends of left and right belts 220 are respectively connected to the rotating shafts 210. Each of second ends of the left and right belts 220 is connected to an opposite one of the left and right side plates 30 and 30' at the junction between the upper and lower plate bodies 31 and 32 of the corresponding side plate 30, 30' so that the left and right belts 220 form an "X" shape. Thus, when the rotating shafts 210 rotate to wind the left and right belts 220 around the corresponding rotating shafts 210, the left and right side plates 30 and 30' are pulled inwards and folded.

Figure 15:
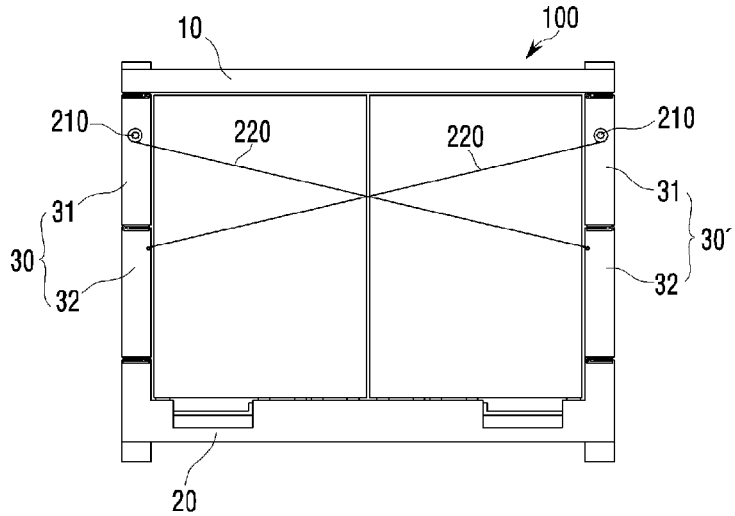
Figure 16:
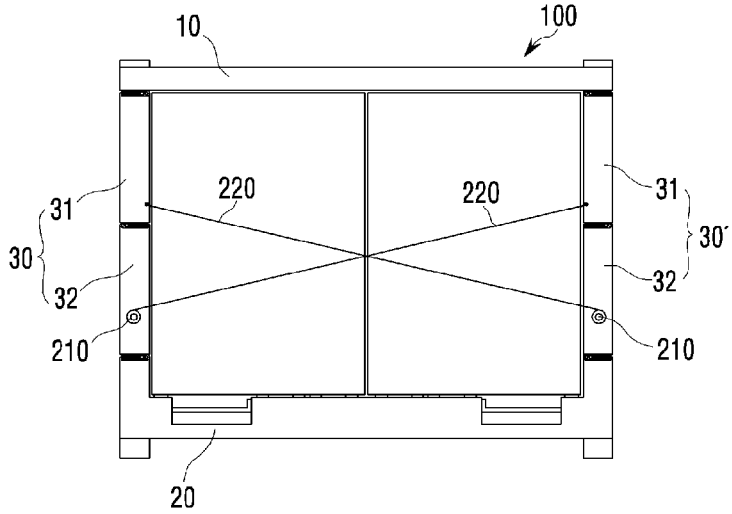

In a further embodiment of the side plate folding means 200, as shown in FIGS. 15 and 16, rotating shafts 210 are respectively and rotatably installed at upper or lower portions of both sidewalls in the container body 210 in the longitudinal direction of the container. First ends of left and right belts 220 are respectively connected to the rotating shafts 210. Each of second ends of the left and right belts 220 is connected to an opposite one of the left and right side plates 30 and 30' at the junction between the upper and lower plate bodies 31 and 32 of the corresponding side plate 30, 30' so that the left and right belts 220 form an "X" shape. Thus, when the rotating shafts 210 rotate to wind the left and right belts 220 around the corresponding rotating shafts 210, the left and right side plates 30 and 30' are pulled inwards and folded.

Figure 17:
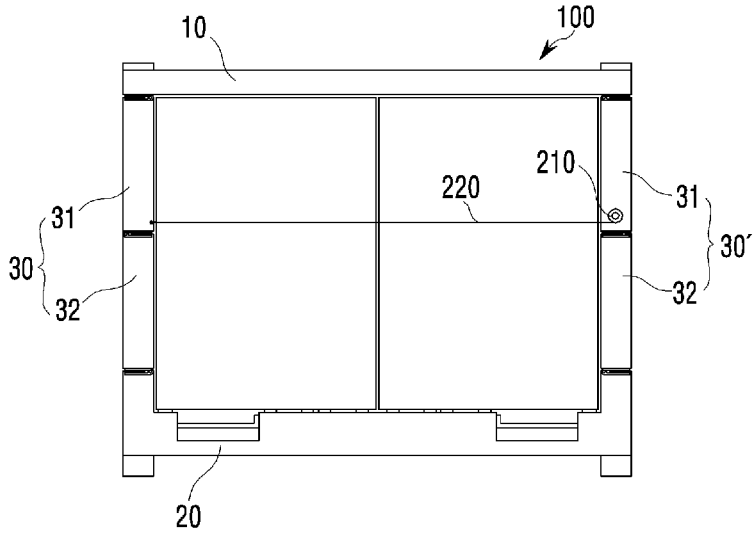
Figure 18:
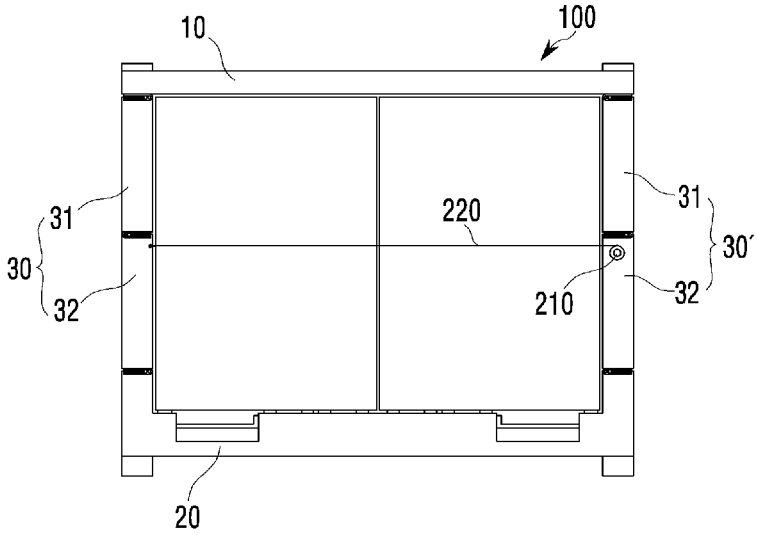

In yet another embodiment of the side plate folding means 200, as shown in FIGS. 17 and 18, a rotating shaft 210 is rotatably installed at an upper or lower portion of one sidewall in the container body 100 in the longitudinal direction of the container. A first end of a belt 220 is connected to the rotating shaft 210. A second end of the belt 220 is horizontally connected to the left or right side plate 30 or 30' that is located opposite of the rotating shaft 210. Thus, when the rotating shaft 210 rotates to wind the belt 220 around the rotating shaft 210, the medial portions of the left and right side plates 30 and 30' are pulled inwards and folded.

Figure 9:
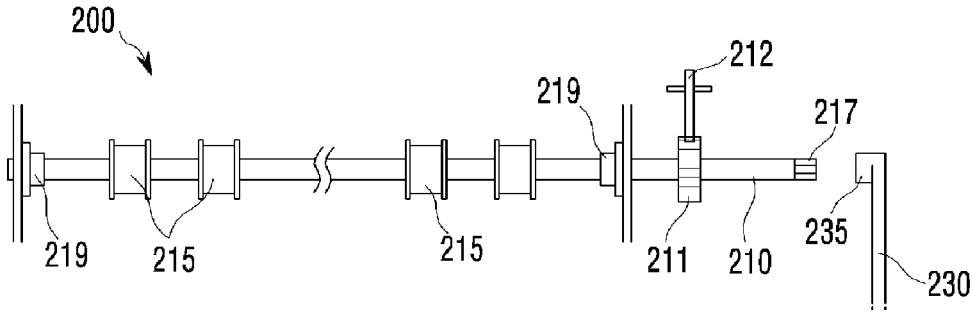
FIG. 9 is a side view showing the construction of a side plate folding means according to the present invention.
Figure 10:
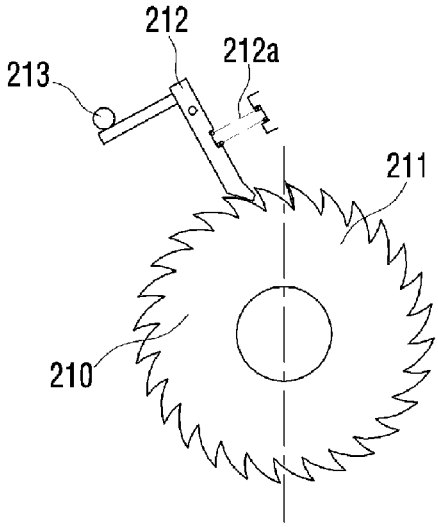
FIG. 10 is a front view showing a ratchet gear of FIG. 9.

As shown in FIGS. 9 and 10, in the side plate folding means 200, a ratchet gear 211 is fitted over the rotating shaft 210. A ratchet pawl 212 is provided at a predetermined position adjacent to the ratchet gear 211. The ratchet pawl 212 is rotatable around a hinge and is elastically brought into contact with the ratchet gear 211 by a compression spring 212*a* so that the ratchet gear 211 is locked to or unlocked from the ratchet pawl 212. Further, a stopper 213 is disposed at a predetermined position adjacent to the ratchet pawl 212 and retractably protrudes to selectively support the ratchet pawl 212 so that the state in which the ratchet gear 211 is unlocked from the ratchet pawl 212 is selectively maintained. Thus, while the ratchet gear 211 is being unlocked from the ratchet pawl 212, the belt 220 can be unwound from the rotating shaft 210.

The rotating shaft 210 is rotatably supported by a separate bearing. A spool 215 is fitted over and fastened to the rotating shaft 210 by a key so that the belt is wound around the spool 215.

In addition, a polygonal protrusion 217 is provided on an end of the rotating shaft 210. The polygonal protrusion 217 is inserted into a through hole 105 formed in the container body 100 so that the polygonal protrusion 217 extends outside the container body 100. Thus, the ratchet handle 230 having a wrench hole 235 is connected to the rotating shaft 210 in such a way that the polygonal protrusion 217 is inserted into the wrench hole 235. Thereby, the rotating shaft 210 can be rotated by rotating the ratchet handle 230 outside the container body 100.

Figure 19:
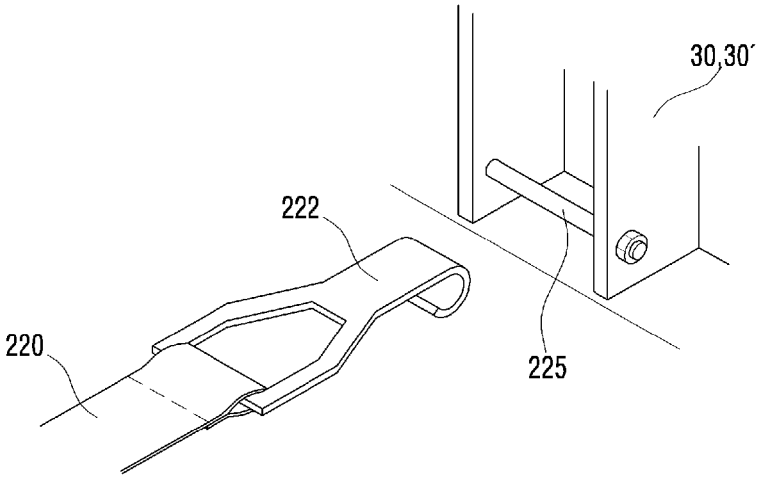
FIG. 19 is a perspective view showing a connection portion of a belt according to the present invention.

As shown in FIG. 19, a reverse U-shaped hook 222 is connected to the second end of the belt 220. A catch rod 225 is provided in the left or right side plate 30, 30' at a position adjacent to the junction between the upper and lower plate bodies 31 and 32 of the side plate 30, 30' so that the reverse U-shaped hook 222 of the belt 220 is removably hooked to the catch rod 225.

Figure 26:
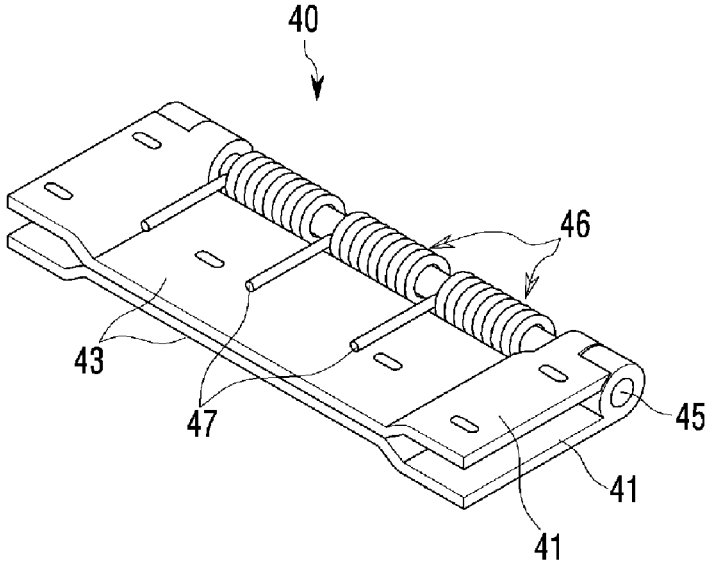
FIG. 26 is a perspective view showing an embodiment of a hinge according to the present invention.
Figure 27:
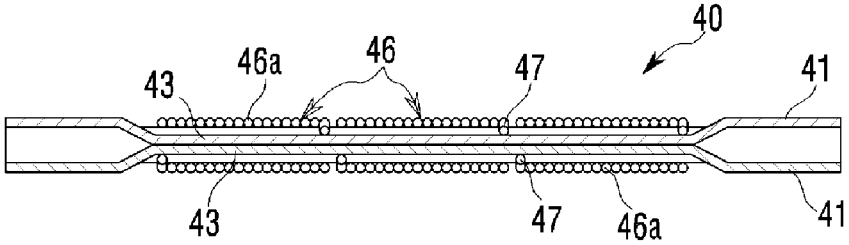
FIG. 27 is a sectional view of FIG. 26.
Figure 28:
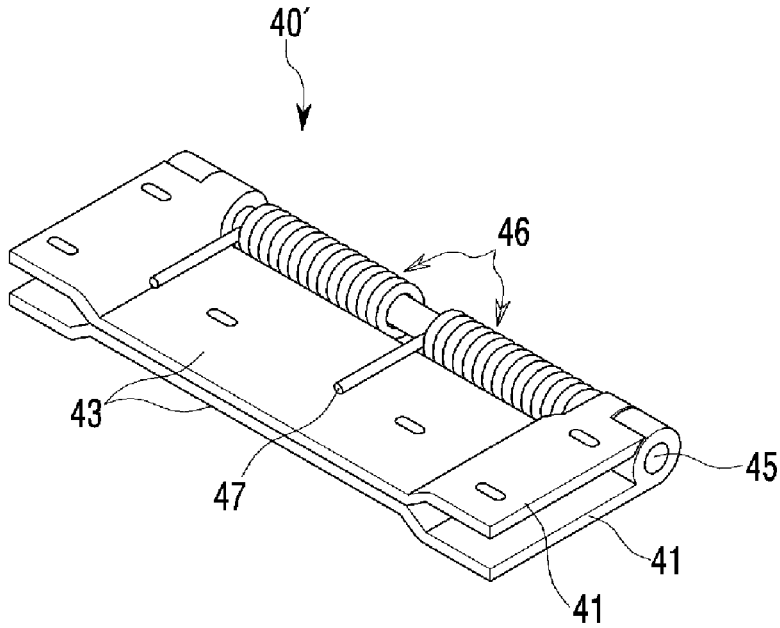
FIG. 28 is a perspective view showing another embodiment of a hinge according to the present invention.

Meanwhile, as shown in FIGS. 26 through 28, each spring hinge 40, 40' includes upper and lower mounting pieces 41 which are rotatably coupled to each other by a shaft pin 45 over which at least one torsion coil spring 46 is fitted. Guide depressions 43 are respectively formed in the outer surfaces of the mounting pieces 41 in such a way as to face each other so that opposite legs 47 of the torsion coil spring 46 are seated into and guided by the guide depressions 43 to prevent the legs 47 from protruding outside the mounting pieces 41 when the legs 47 are moved in the axial direction by torsion of the torsion coil spring 46.

The spring hinge 40, 40' may be configured such that the number of torsion coil springs 46 is changed depending on the load applied to the spring hinge 40, 40'. Preferably, the number of torsion springs 46 of each of the spring hinges that rotate to 180° and are installed between the upper and lower plate bodies 31 and 32 of the left and right side plates 30 and 30' is greater than the number of torsion springs 46 of each of the springs hinges that rotate to 90° and are installed between the top plate 10 and the upper plate bodies 31 of the left and right side plates 30 and 30' and between the bottom plate 20 and the lower plate bodies 32 of the left and right side plates 30 and 30'.

Furthermore, the spring hinge 40, 40' is configured such that the number of turns of the wire 46*a* of each torsion coil spring 46 is different for the different loads applied to the spring hinge 40, 40'. Preferably, the number of turns of the wire 46*a* of each torsion coil spring 46 of the spring hinges that rotate to 180° and are installed between the upper and lower plate bodies 31 and 32 of the left and right side plates 30 and 30' is greater than that of each torsion coil spring 46 of the springs hinges that rotate to 90° and are installed between the top plate 10 and the upper plate bodies 31 of the left and right side plates 30 and 30' and between the bottom plate 20 and the lower plate bodies 32 of the left and right side plates 30 and 30'.

Figure 29:
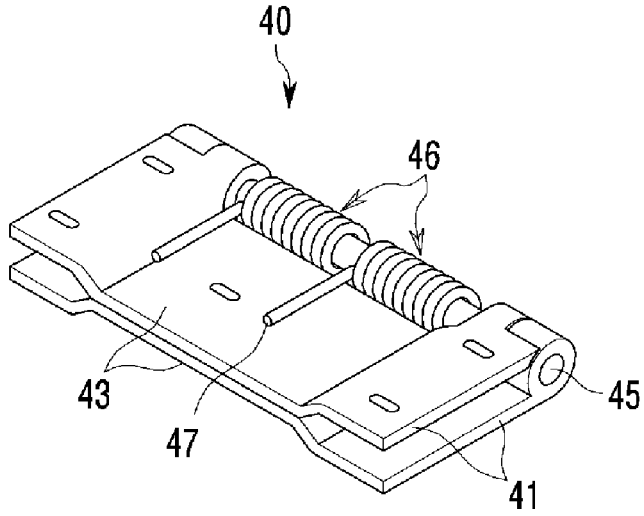
FIG. 29 is a perspective view showing a further embodiment of a hinge according to the present invention.
Figure 30:
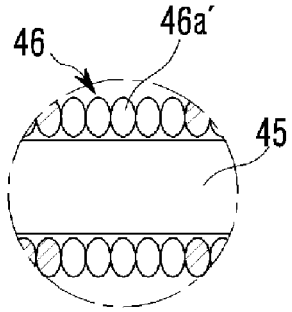
FIG. 30 is a sectional view of a spring of FIG. 29.
Figure 31:
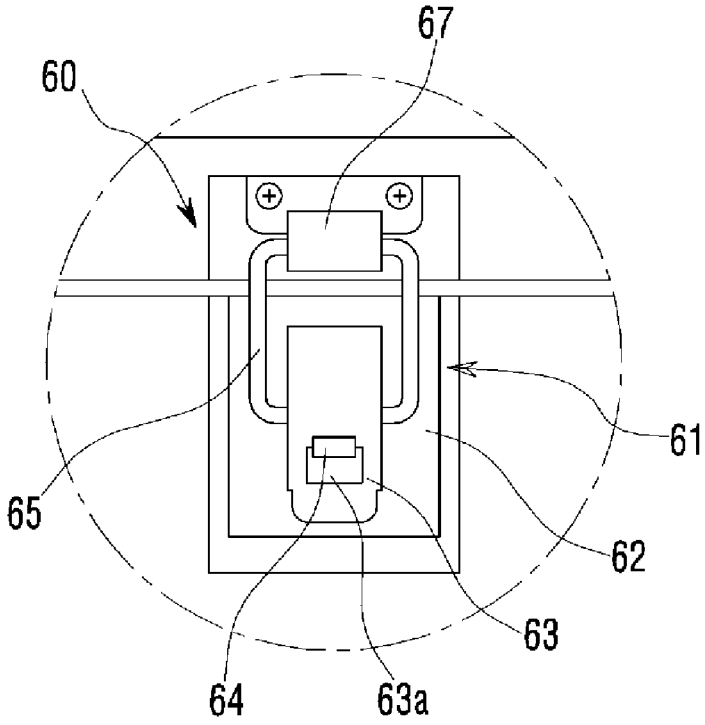
FIGS. 31 through 33 are front views showing several embodiments of a catch clamp according to the present invention.

As shown in FIGS. 29 and 30, in the spring hinge 40, 40', the wire 46*a*' of the torsion coil spring 46 is configured such that the cross-section thereof has an elliptical shape which has a vertical major axis and is reduced in a diameter with respect to the longitudinal direction of the spring 46. Thereby, the spring hinge 40, 40' is compact in the longitudinal direction of the spring 46.

As such, because the spring hinge 40, 40' has the compact structure with respect to the longitudinal direction, the number of spring hinges arranged in the longitudinal direction of the container body can be increased compared to that of the conventional technique. Thereby, the elastic force of the spring hinges 40 and 40' can be increased so that the container body 100 which has been in the folded state can be easily unfolded.

Figure 20:
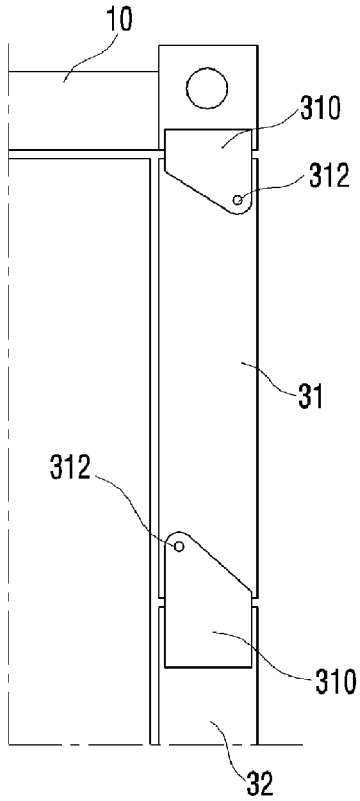
FIG. 20 is a front view showing the construction of a side plate support unit according to the present invention.
Figure 21:
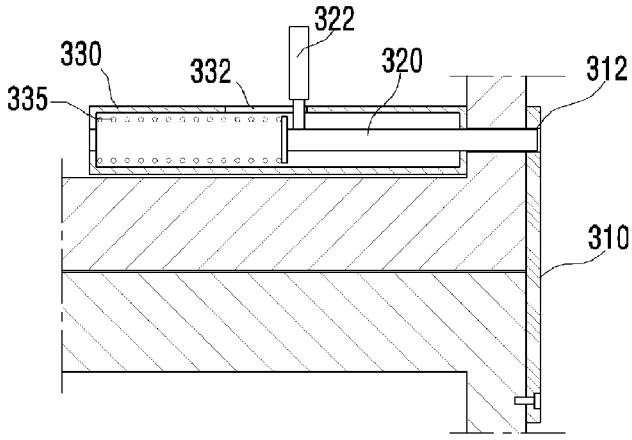
FIG. 21 is a sectional view showing the construction of an important portion of FIG. 20.
Figure 22:
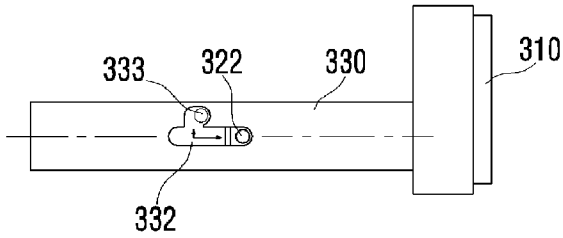
FIG. 22 is a plan view showing the important portion of FIG. 20.

Furthermore, as shown in FIGS. 20 and 22, the present invention further includes a plurality of side plate support units 300 each of which has a connection bracket 310 and a fastening bar 320. The connection bracket 310 is provided on each of the front and rear ends of the junctions between the top plate 10 and the upper plate bodies 31 of the left and right side plates 30 and 30', between the upper and lower plate bodies 31 and 32 of the left and right side plates 30 and 30', and between the lower plate bodies 32 of the left and right side plates 30 and 30' and the bottom plate 20. A first end of the connection bracket 310 is fastened to one of the associated pair of elements, and the fastening bar 320 is installed in the other one of the associated pair of elements and is elastically and removably inserted into a support hole 312 formed in a second end of the connection bracket 310. The fastening bar 320 is installed in a bar housing 330. A guide slot 332 is formed in the bar housing 330 in the longitudinal direction of the bar housing 330, and a locking slot 333 extends from a rear end of the guide slot 332 in the circumferential direction. A protrusion handle 322 provided on a predetermined portion of the fastening bar 320 elastically moves along the guide slot 332 or the locking slot 333 so that the fastening bar 320 is inserted into the support hole 312 of the connection bracket 310 to support the connection bracket 310 and prevent the left and right side plates 30 and 30' from being folded or is removed from the support hole 312 of the connection bracket 310 to release the connection bracket 310.

Here, the connection brackets 310 that pertain to the top plate 10 and the bottom plate 20 are configured such that they are fastened to the top plate 10 and the bottom plate 20.

Figure 23:
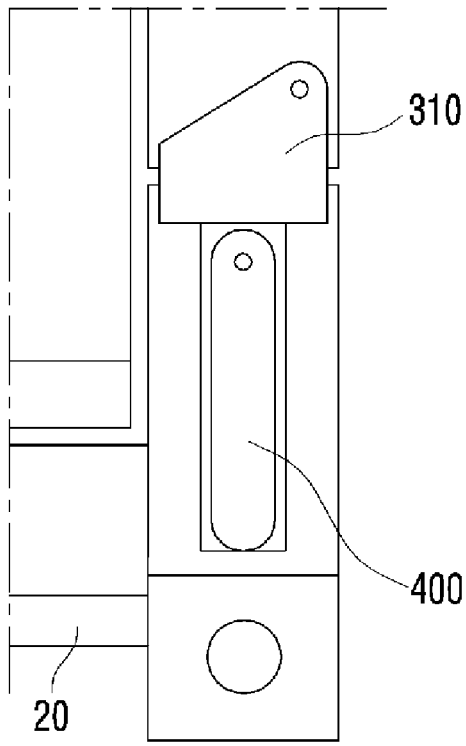
FIG. 23 is a front view showing the installation of a holding plate according to the present invention.
Figure 24:
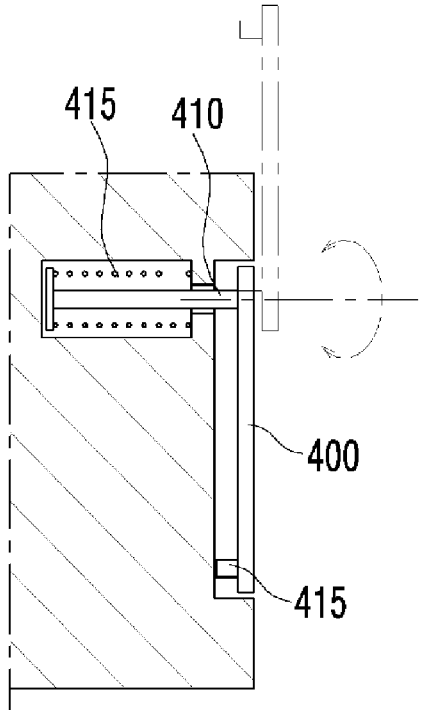
FIG. 24 is a side sectional view of FIG. 23.
Figure 25:
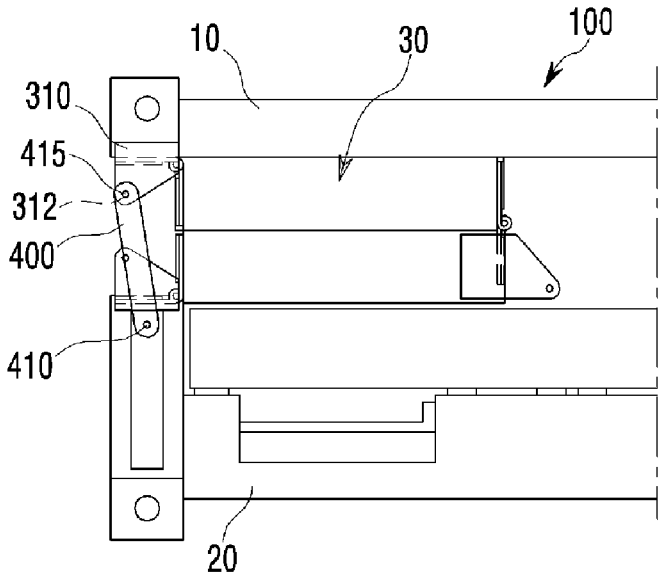
FIG. 25 is view showing the operation of FIG. 23.

Furthermore, as shown in FIGS. 23 through 25, the present invention further includes a plurality of holding bars 400 which are provided on the front and rear ends of the bottom plate 20 below the corresponding connection brackets 310. A hinge pin 410 is provided on an upper portion of each holding bar 400. The holding bar 400 is rotated around the hinge pin 410 and is elastically extracted from or retracted into the bottom plate 20. A fastening pin 415 protrudes inwards from a lower end of the holding bar 400 so that when the container body 100 is folded, the fastening pin 415 can be inserted into the support hole 312 of the connection bracket 310 fastened to the top plate 10, thus maintaining the folded state of the container body 100.

Due to this structure, the elastic force of the spring hinges 40 can be restricted when the top plate 10, the left and right side plates 30 and 30' and the bottom plate 20 are in the folded state, thus facilitating the operation of locking or unlocking the catch clamps 60.

Figure 32:
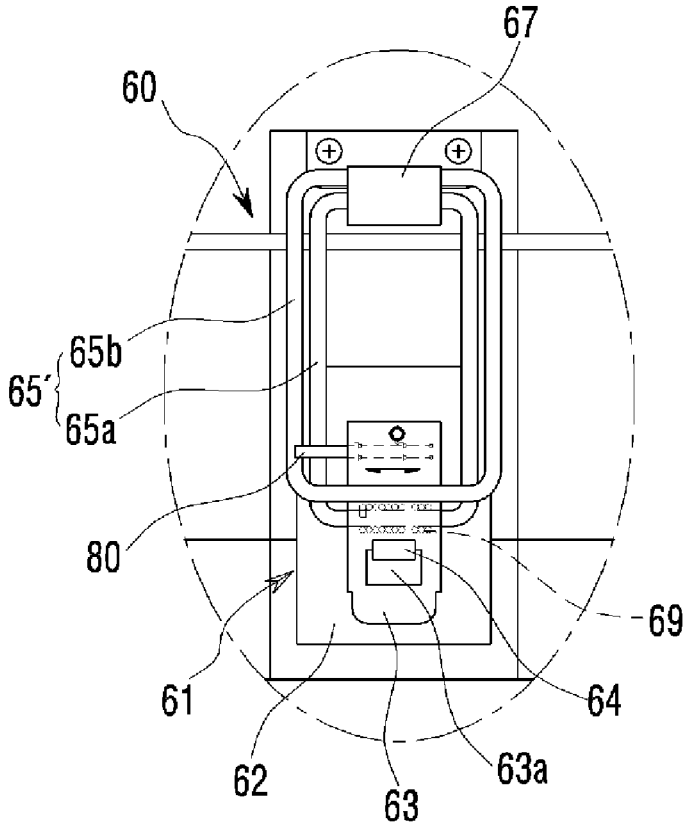

Meanwhile, as shown in FIG. 32, in the present invention, of the catch clamps 60 disposed on the lower ends of the left and right side plates 30 and 30' of the container body 100, each of the catch clamps 60 which are disposed at opposite ends of the left and right side plates 30 and 30' includes a double locking hook 65' comprising two locking hooks 65*a* and 65*b* which are rotatably connected to each other by a connection ring 66. The locking hooks 65*a* and 65*b* are selectively locked to the latch 67 that is provided on the lower plate body of the left or right side plate 30, 30' or locked to the latch 67 that is provided on the top plate 10 when the container body 100 is folded.

The locking hook 65*a* of the double locking hook 65' is elastically biased upwards by a torsion spring 69 to prevent the double locking hook 65' from hanging down and making contact with the ground. Further, a support pin 80 is retractably extracted from one side of the clamp part 61 to restrict the elastic upward rotation of the double locking hook 65' so that the double locking hook 65' is prevented from coming into contact with a lower portion of the corresponding latch of the side plate, thus preventing the operation of folding the side plate onto the bottom plate 20 from not working properly.

In this embodiment, the support pin 80 is configured such that it is pushed by a worker's hand to be retracted into the clamp part 61 and is elastically extracted from the clamp part 61 by manipulating a button.

Figure 33:
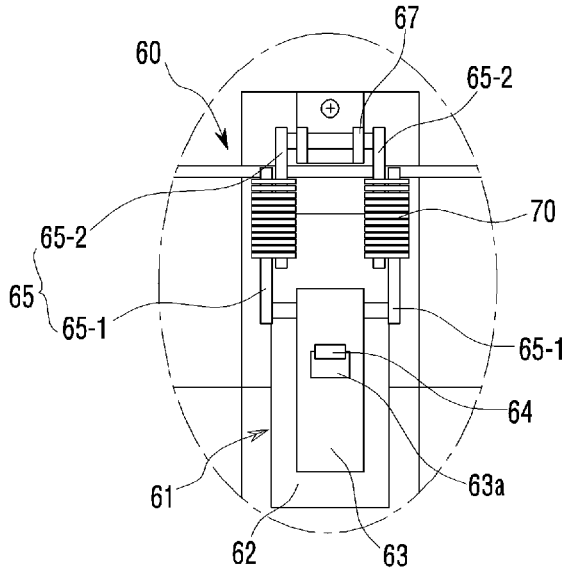
Figure 34:
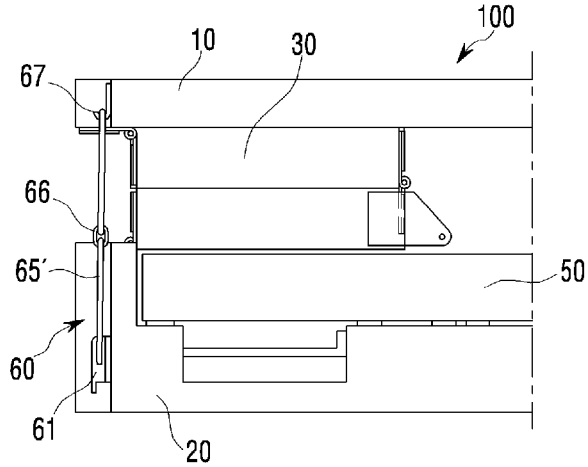
FIG. 34 is a front view showing use of a double hook of the catch clamp according to the present invention.

Alternatively, in the present invention, as shown in FIG. 33, of the catch clamps 60 disposed on the lower ends of the left and right side plates 30 and 30' of the container body 100, each of the catch clamps 60 which are disposed at opposite ends of the left and right side plates 30 and 30' may include a clamp part 61 comprising upper and lower locking hooks 65-1 and 65-2 which are connected at opposite ends thereof to each other by coil springs 70. The locking hooks 65-1 and 65-2 are connected to each other in such a way that the opposite ends thereof pass through the corresponding coil springs 70 and are locked to the corresponding opposite ends of the coil springs 70. Thus, when a first one of the left and right side plates 30 and 30' is unfolded after a second one of them has been vertically unfolded, the coil springs 70 elastically support the unfolded second side plate such that the second side plate can be prevented from leaning towards the first side plate at the junction between the second side plate and the bottom plate.

Figure 35:
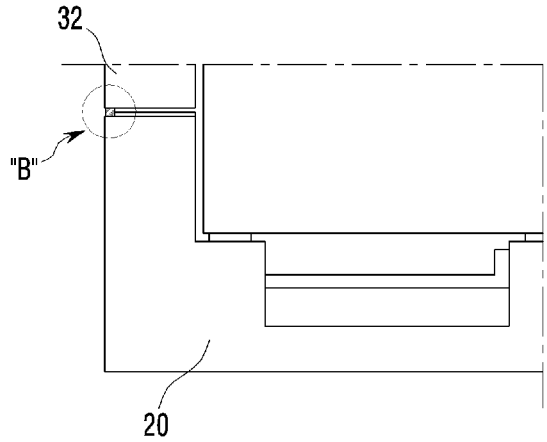
FIG. 35 is a sectional view showing the coupling structure of a sealing packing according to the present invention.
Figure 36:
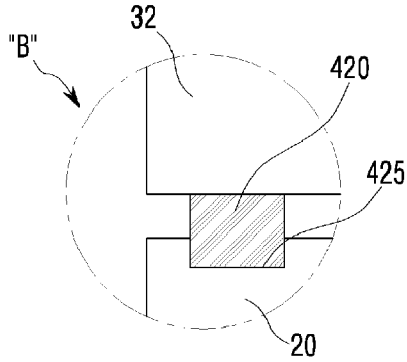
FIG. 36 is an enlarged view of a circled portion "B" of FIG. 35.
Figure 37:
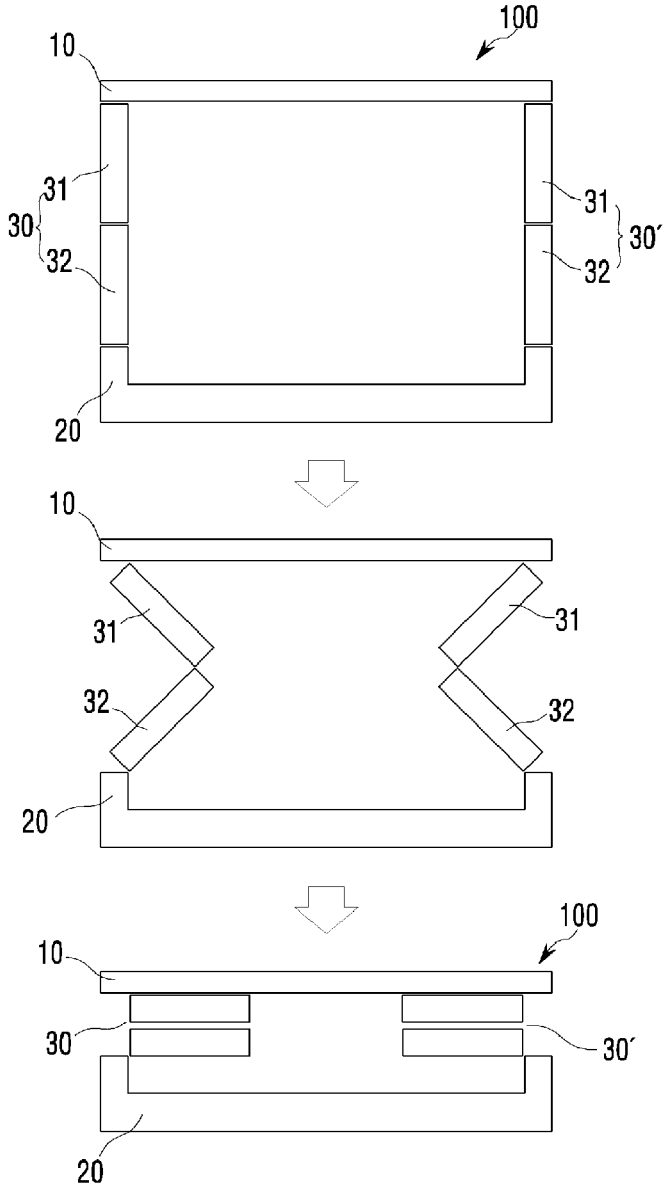
FIGS. 37 and 38 are views successively showing examples of a process of folding a container body according to the present invention.
Figure 38:
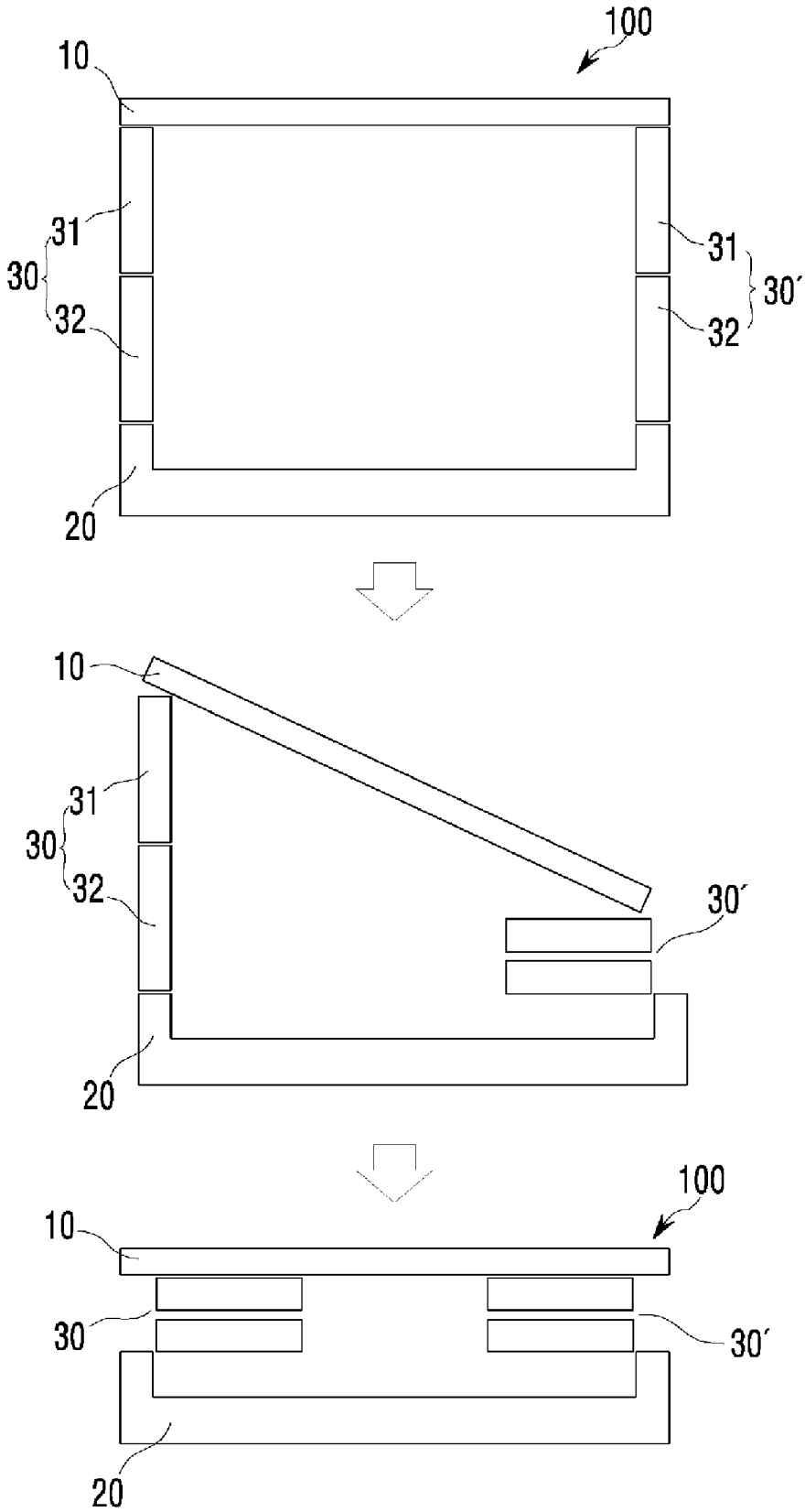

Meanwhile, as shown in FIGS. 35 and 36, a seating groove 425 is formed in the perimeter of each of the contact surfaces between the top plate 10, the upper and lower plate bodies 31 and 32 of the left and right side plates 10 and 20 and the bottom plate 20. A silicone packing 420 is seated into the seating groove 425 to ensure that the seal is in place between the associated pair of elements.

Furthermore, a door 150 is provided in the medial portion of each of the left and right side plates 30 and 30' of the container body 100 and is rotated around a hinge provided on one side of the door 150 to open and close it. A guide surface 55 having an entrance ramp 56 at an outer side thereof is formed on each of the opposite ends of the inner surfaces of the front and rear end plates 50 and 50' so that, for example, when vehicles are loaded into the container, the vehicles enter the container using the guide surface 55.

In the drawings, the reference numeral 219 denotes a support bearing of the rotating shaft 210, and the reference numerals 335 and 415 respectively denote springs which elastically support the fastening bar 320 and the hinge pin of the holding bar 400.

The operation and effect of the present invention having the above-mentioned construction will be described below.

First, when the folding container of the present invention is empty and contains no cargo, the container body 100 is maintained in the folded state to be stored, loaded, unloaded or transported.

In detail, the catch clamps 60 which have fastened the front and rear end plates 50 and 50' of the container body 100 to the top plate 10 are loosened. The front and rear end plates 50 and 50' are subsequently rotated around the lower hinges 40" inwards and folded onto the upper surface of the bottom plate 20 in the container body 100.

Thereafter, the catch clamps 60 which have fastened the left and right side plates 30 and 30' to the top plate 10 and the bottom plate 20 are loosened.

Subsequently, the top plate 10, the left and right side plates 30 and 30' and the bottom plate 20, which have been vertically supported by the connection brackets 310 provided on the front and rear ends of the junctions between the top plate 10 and the upper plate bodies 31 of the left and right side plates 30 and 30', between the upper and lower plate bodies 31 and 32 of the left and right side plates 30 and 30' and between the lower plate bodies 32 of the left and right side plates 30 and 30' and the bottom plate 20, are released from the connection brackets 310.

In other words, the worker holds the protrusion handle 322 of the fastening bar 320 that is elastically inserted in the support hole 312 of the connection bracket 310, elastically moves the protrusion handle 322 backwards along the guide slot 332 of the bar housing 330, and then rotates and locates the protrusion handle 322 such that it is locked to and supported by the locking slot 333 extending from the guide slot 332.

At this time, the fastening bar 320 is removed from the support hole 312 of the connection bracket 310 so that the corresponding elements which have been vertically supported by the connection bracket 310 are released therefrom.

Thereafter, the top plate 10, the left and right side plates 30 and 30' and the bottom plate 20 of the container body 100 are rotated around the corresponding hinges 40 and 40' inwards to be folded.

Particularly, in the present invention, because the side plate folding means 200 is used, the top plate 10, the left and right side plates 30 and 30' and the bottom plate 20 of the container body 100 can be easily and safely folded by a small number of workers.

In detail, to rotate the rotating shaft 210 in the container body 100 in the direction in which the belt 220 is unwound, the stopper 213 is retracted so that the ratchet pawl 212 to which the ratchet gear 211 has been locked releases the ratchet gear 211 to allow the ratchet gear 211 to rotate in the direction in which the belt 220 is unwound.

Thereafter, while the belt 220 is unwound from the spool 215 of the rotating shaft 210, the reverse U-shaped hook 222 provided on the end of the belt 220 is hooked to the catch rod 225 which is provided between the upper and lower plate bodies 31 and 32 of the left or right side plate 30, 30'.

Subsequently, the stopper 213 is extracted to support the ratchet pawl 212 so that the ratchet gear 211 of the rotating shaft 210 is locked to the ratchet pawl 212 again, thus restricting the ratchet gear 211 from rotating in the direction in which the belt 220 is unwound.

From this state, the rotating shaft 210 is rotated to wind the belt 220 around the spool 215.

To wind the belt 220 around the spool 215, the wrench hole 235 of the ratchet handle 230 is fitted over the polygonal protrusion 217 of the rotating shaft 210 that is inserted into the through hole 105 formed in the outer surface of the container body 100, and then the ratchet handle 230 is rotated. Thereby, the rotating shaft 210 is rotated, thus winding the belt 220 around the spool 215.

Due to the operation of rotating the rotating shaft 210 to wind the belt 220, the belt 220 pulls the left and right side plates 30 and 30' inwards. Thus, the left and right side plates 30 and 30' are folded while the upper and lower plate bodies 31 and 32 elastically rotate inwards around the spring hinges 40 and 40' that are disposed at the junctions between the upper and lower plate bodies 31 and 32 of the left and right side plates 30 and 30', between the top plate 10 and the upper plate bodies 31 of the left and right side plates 30 and 30' and between the bottom plate 20 and the lower plate bodies 32 of the left and right side plates 30 and 30'.

Here, as mentioned above, the position at which the rotating shaft 210 is disposed in the container body 100 can be changed to be located at various other positions.

For example, as shown in FIGS. 11 and 12, the rotating shaft 210 may be rotatably disposed at the central portion of the ceiling or the bottom in the container body 100 in the longitudinal direction of the container. In this case, the left and right belts 220 are wound around the spool 215 of the rotating shaft 210 in opposite directions. The ends of the left and right belts 220 are respectively connected to the medial portions of the left and right side plates 30 and 30'. When the rotating shaft 210 rotates, the left and right belts 220 are wound around the spool 215 at the same time so that the left and right side plates 30 and 30' are simultaneously pulled inwards and folded.

Alternatively, as shown in FIGS. 13 and 14, the two rotating shafts 210 may be respectively disposed at both sides of an upper or lower portion in the container body 100 in the longitudinal direction of the container. In this case, the left and right belts 220 are connected to the spools 215 of the corresponding rotating shafts 210. The ends of the left and right belts 220 are connected to the medial portions of the corresponding left and right side plates 30 and 30' so that the left and right belts 220 form an "X" shape. When the rotating shafts 210 rotate to wind the left and right belts 220 around the corresponding spools 215, the left and right side plates 30 and 30' are pulled inwards and folded.

As a further alternative, as shown in FIGS. 15 and 16, the two rotating shafts 210 may be disposed at upper or lower portions of both sidewalls in the container body 100. In this case, the left and right belts 220 are connected to the spools 215 of the corresponding rotating shafts 210. The ends of the left and right belts 220 are connected to the medial portions of the corresponding left and right side plates 30 and 30' so that the left and right belts 220 form an "X" shape. When the rotating shafts 210 rotate to wind the left and right belts 220 around the corresponding spools 215, the left and right side plates 30 and 30' are pulled inwards and folded.

As a further alternative, as shown in FIGS. 17 and 18, the single rotating shaft 210 and the single belt 215 may be used. For this, the rotating shaft 210 is disposed at an upper or lower portion of one sidewall in the container body 100. The end of the belt 220 connected to the spool 215 of the rotating shaft 210 is horizontally connected to the side plate 30 or 30' that is located opposite the rotating shaft 210. When the rotating shaft 210 rotates to wind the belt 220 around the spool 215, the left and right side plates 30 and 30' are pulled inwards and folded.

As such, in the present invention, because the left and right side plates are folded by rotating the rotating shaft 210, the operation of folding the container body 100 can be easily performed by a small number of workers. Further, the workers can be outside the container body 100 while it is being folded, thus maintaining safety during the folding operation.

After the container body 100 has been folded, the container body 100 can be maintained in the folded state by the catch clamps 60 that are disposed on the opposite ends of the two sides of the bottom plate 20.

For this, each catch clamp 60 includes the double locking hook 65' that comprises the two locking hooks 65*a* and 65*b* which are rotatably connected to each other by the connection ring 66. The double locking hooks 65' of the catch clamps 60 are hooked to the corresponding latches 67 that are disposed on the top plate 10. Thereby, the top plate 10, the left and right side plates 30 and 30', the bottom plate 20, and the front and rear end plates 50 and 50' are maintained in the folded state.

The container body 100 stays in the folded state when it is being stored, loaded, unloaded or transported.

To store various kinds of cargo in the container body 100 that is in the folded state, the container body 100 must be unfolded.

To unfold the folded container body 100, first, the double locking hooks 65' of the catch clamps 60 which have maintained the container body 100 in the folded state are unlocked.

Here, the operation of unlocking the double locking hooks 65' of the catch clamps 60 is conducted while the holding bars 400 maintain the container body 100 in the folded state. For this, the holding bars 400 that are disposed on the opposite sides of the front and rear ends of the bottom plate 20 are elastically extracted out of the bottom plate 20 and rotated upwards around the corresponding hinge pins 410. Subsequently, the fastening pins 415 of the holding bars 400 are inserted into the corresponding support holes 312 of the connection brackets 310 disposed on the top plate 10, thus maintaining the folded state of the container body 100. Under this state, the double locking hooks 65' of the catch clamps 60 are unlocked.

In this state, the container body 100 is supported by the holding bars 400, so that the elastic force of the spring hinges 40 is restricted. Therefore, the operation of unlocking the double locking hooks 65' of the catch clamps 60 can be facilitated.

After the double locking hooks 65' have been unlocked, one side plate 30 or 30' is unfolded in the vertical direction by removing the corresponding holding bars 400 from the top plate 10. The side plate 30 or 30' is vertically unfolded by the elastic force of the torsion coil springs 46 of the corresponding spring hinges 40 and 40' that are provided between the top plate 10, the upper and lower plate bodies 31 and 32 of the side plate 30 or 30' and the bottom plate 20.

When in this state, the upper and lower plate bodies 31 and 32 of the side plate 30 or 30' that are vertically unfolded are supported by the corresponding connection brackets 310 to be kept in the vertically unfolded state.

In detail, the protrusion handle 322 of each fastening bar 320 which has been locked to the corresponding locking slot 333 of the bar housing 330 is removed from the locking slot 333 so that the fastening bar 320 is elastically advanced and inserted into the support hole 312 of the corresponding connection bracket 310. Then, the upper and lower plate bodies 31 and 32 of the side plate 30 or 30' which are vertically unfolded can be maintained in the vertical state by the connection brackets 310.

Furthermore, in the case where, of the catch clamps 60 disposed on the lower ends of the left and right side plates 30 and 30', each of the catch clamps 60 which are disposed at opposite ends of the side plates 30 or 30' is configured such that the locking hook 65 is separated into the upper and lower parts that are elastically connected to each other by the coil springs 70', the locking hooks 65 of the catch clamps 60 are elastically hooked to the corresponding latches 67 so that they are elastically locked to the lower plate body 32 of the side plate 30 or 30'.

As such, the upper and lower plate bodies 31 and 32 of the side plate 30 or 30' which have been vertically unfolded are vertically supported by the connection brackets 310, and the lower body 32 is fastened to the bottom plate 20 by the catch clamps 60 having the locking hooks 65 with the coil springs 70. Therefore, when the other side plate 30 or 30' is unfolded in the vertical direction, the upper and lower plate bodies 31 and 32 of the pre-unfolded side plate 30 or 30' can be prevented from being bent and inclined towards the side plate 30 or 30' to be unfolded. Furthermore, because the locking hooks 65 of the catch clamps 60 are locked to the lower body of the pre-unfolded side plate 30 or 30' and the coil springs 70 of the catch clamps 60 are elastically extended, the pre-unfolded side plate 30 or 30' is prevented from leaning towards the worker.

Under this state, the side plate 30 or 30' that is located opposite the pre-unfolded unfolded side plate 30 or 30' can be safely unfolded in the vertical direction. Of course, in the same manner, this side plate 30 or 30' is unfolded in the vertical direction by the elastic force of the torsion coil springs 46 of the spring hinges 40 and 40' that are provided between the top plate 10, the upper and lower plate bodies 31 and 32 of the side plate 30 or 30' and the bottom plate 20.

Particularly, in the present invention, each spring hinge 40, 40' is configured such that the guide depressions 43 are formed in the outer surfaces of the mounting pieces 41 so that the opposite legs 47 of the torsion coil springs 46 are prevented from protruding outside the mounting pieces 41. In addition, when the torsion coil springs 46 are twisted, the legs 47 move along the guide depressions 43. Thus, the top plate 10, the left and right side plates 30 and 30' and the bottom plate 20 can be smoothly folded or unfolded.

Preferably, the number of torsion coil springs 46 of each of spring hinges 40 that are provided at the junction between the upper and lower plate bodies 31 and 32 of the left and right side plates 30 and 30' and which rotate within an angular range of 180° is greater than that of each of spring hinges 40' that are provided at the junctions between the top plate 10 and the upper plate bodies 31 of the left and right side plates 30 and 30' and between the bottom plate 20 and the lower plate bodies 32 of the left and right side plates 30 and 30' and which rotate within an angular range of 90°. In addition, the number of turns in each torsion coil spring 46 of the spring hinges 40 that rotate within an angular range of 180° may be greater than that of each torsion coil spring 46 of the spring hinges 40 that rotate within an angular range of 90°. Thereby, the operational efficiency and the durability of the container can be enhanced.

Further, the wire 46*a* of each torsion coil spring 46 is configured such that the cross-section thereof has an elliptical shape which has a vertical major axis and is reduced in a diameter with respect to the longitudinal direction of the spring 46 so that the torsion coil spring 46 is compact in the longitudinal direction of the spring 46. Hence, the number of spring hinges 40, 40' that can be installed increases, thus enhancing the elastic force of the spring hinges 40, 40'. Thereby, the operation of unfolding the left and right side plates 30 and 30' can be more smoothly conducted.

After the container body 100 is unfolded, the upper plate bodies 31 of the left and right side plates 30 and 30' are fastened to the top plate 10 by the corresponding catch clamps 60, and the lower plate bodies 32 of the left and right side plates 30 and 30' are fastened to the bottom plate 20 by the corresponding catch clamps 60.

Furthermore, the top plate 10, the bottom plate 20 and the upper and lower plate bodies 31 and 32 of the left and right side plates 30 and 30' are fastened to each other by the connection brackets 310. For this, the protrusion handle 322 of each fastening bar 320 which has been locked to the corresponding locking slot 333 of the bar housing 330 is removed from the locking slot 333 so that the fastening bar 320 is elastically advanced and inserted into the support hole 312 of the corresponding connection bracket 310. Then, the top plate 10, the bottom plate 20 and the upper and lower plate bodies 31 and 32 of the side plates 30 and 30' which are vertically unfolded can be maintained in the vertically supported state by the connection brackets 310.

As such, after the container body 100 has been completely unfolded, various kinds of cargo are stored in the container body 100.

For example, when vehicles are loaded into the container body 100, the vehicles can more smoothly move along the entrance ramps 56 of the guide surfaces 55 which are formed on the opposite ends of the front and rear end plates 50 and 50'.

Moreover, the door 150 which is provided in each of the left and right side plates 30 and 30' and is rotated by the hinges can be used to open up the container body 100. A worker can easily enter and exit the container body 100 through the door 150.

In the folding container of the present invention having the above-mentioned construction and operation, when loading or unloading the container, corner castings 500 which are provided on the respective corners of the top plate are held and moved by a container handling machine. At this time, the container body 100 can be reliably maintained in the vertically supported state by the spring hinges 40 and 40', the catch clamps 60 and the connection brackets 310.

Furthermore, the silicone packings 420 are installed in the easing grooves 425 which are formed in the perimeters of the contact surfaces between the top plate 10, the upper and lower plate bodies 31 and 32 of the left and right side plates 10 and 20 and the bottom plate 20, thus ensuring the sealing between the associated pair of elements. Therefore, water can be reliably prevented from penetrating the container so that cargo can be safely stored, loaded, unloaded and transported.

As described above, a folding container according to the present invention stores various kinds of cargo therein and is transported by a ship or the like, wherein a small number of workers can easily fold or unfold the container body using a folding means so that it is convenient to handle the container and the use of space is optimized. Further, the folding container has a superior durability and is able to be safely used, because the container body can reliably maintain the folded or unfolded state.

In particular, the folding means is configured such that a belt wound around the rotating shaft is connected to the left and right side plates at portions adjacent to the junctions between the upper and lower plate bodies of the left and right side plates. Thus, the left and right side plates are pulled inwards and folded only by the worker who is outside the container body performing the simple operation of rotating the rotating shaft using a ratchet handle to wind the belt around the rotating shaft. Therefore, only a small number of workers are required to perform the operation of folding the container body, the folding operation can be facilitated, and the safety of the operation can be ensured.

Furthermore, the top plate, the left and right side plates and the bottom plate of the container body are connected to each other not only by spring hinges but also by connection brackets after they have been vertically unfolded. Hence, the durability of the container body with respect to the vertical or horizontal direction can be markedly enhanced even when corner castings provided on the respective corners of the top plate are held, lifted and moved by a container handling machine to move the container body.

The cross-sectional structure of the spring wire is improved and the number of torsion coil springs of the spring hinges or the number of turns of a wire of each torsion coil spring is different depending on the load applied thereto, for example, those of the spring hinges that rotate by up to 180° and are installed between the upper and lower plate bodies of the left and right side plates are greater than those of the springs hinges that rotate up to 90° and are installed between the top plate and the upper plate bodies of the left and right side plates and between the bottom plate and the lower plate bodies of the left and right side plates. Thereby, the number of torsion coil springs can be increased compared to that of the conventional technique, so that the durability of the container body is enhanced, and the container body can be more easily unfolded by the increased elastic force of the spring hinges. Furthermore, each spring hinge has a guide depression so that when each torsion coil spring is twisted, the axial movement of opposite legs of the torsion coil spring is guided by the guide depression, and the opposite legs are prevented from protruding outside the spring hinge, thus enhancing the operational efficiency and the durability of the container.

In addition, from the state in which double locking hooks of the catch clamps disposed on the bottom are locked to corresponding latches disposed on the top plate to maintain the container body in the folded state, the top and bottom plates are connected to each other by separate holding bars before the double locking hooks of the catch clamps are unlocked from the latches. Thus, the operation of unlocking the double locking hook from the latches can be facilitated regardless of the elastic force of the spring hinges. Each double locking hook of the catch clamps is supported by a separate support pin to restrain the double locking hook from rotating upwards or downwards, so that unlike the conventional technique, the double locking hook is prevented from being caught between the corresponding side plate or the lower end of the latch of the side plate and the bottom plate, thus making the operation of folding the left and right side plates smooth.

When a first one of the left and right side plates of the container body which has been folded is unfolded after a second one of them is vertically unfolded, the second side plate is maintained in the vertical unfolded state by the catch clamps and the connection brackets that pertain to the second side plate. Therefore, the second side plate which has been in the vertically unfolded state is prevented from bending and becoming inclined towards the first side plate, and the first side plate is prevented from leaning towards a worker, thus facilitating the unfolding operation and enhancing safety.

Furthermore, a silicone packing is installed in the junctions between the top plate, the bottom plate and the upper and lower plate bodies of the left and right side plates, thus enhancing the sealing ability and preventing water from coming in. In addition, guide surfaces are formed on the front and rear end plates of the container body to guide the entrance of vehicles when loading the vehicles into the container body, thus facilitating the operation of loading the vehicle. Further, a separate door is provided on each of the left and right side plates so that a worker can easily enter the container body.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A folding container, comprising:

a container body defining a loading space therein, the container body comprising: a top plate; a bottom plate; left and right side plates vertically provided at opposite sides between the top plate and the bottom plate, each of the left and right side plates comprising upper and lower plate bodies connected to each other and to the top and bottom plates in a longitudinal direction of the container body by spring hinges provided both on an outer portion between the upper and lower plate bodies and on inner portions of upper and lower ends of the upper and lower plate bodies so that the upper and lower plate bodies are foldable inwards in such a way to face each other; and front and rear end plates respectively coupled to front and rear edges of the bottom plate by bottom hinges so as to be rotatable and foldable inwards or outwards;

at least one catch clamp provided on each of junctions between the top plate and the upper plate bodies of the left and right side plates, between the bottom plate and the lower plate bodies of the left and right side plates, and between the top plate and the front and rear end plates to releasably lock the associated pair of elements to each other, the catch clamp comprising: a clamp part and a latch disposed at corresponding positions facing each other, the clamp part having a locking hook provided so as to be rotatable around a shaft so that the locking hook is releasably locked to the latch; and a side plate folding means comprising a rotating shaft rotatably installed in the container body in the longitudinal direction of the container body, the rotating shaft being connected to the junction of the upper or lower side plates of the left and right side plates by a belt so that, when the rotating shaft rotates to wind the belt around the rotating shaft, the upper and lower plate bodies of the left and right side plates are pulled inwards and folded.

2. The folding container as set forth in claim 1, wherein the rotating shaft of the side plate folding means comprises a rotating shaft rotatably installed at a central portion of a ceiling in the container body in the longitudinal direction of the container body, wherein first ends of left and right belts are wound around the rotating shaft in opposite directions, and second ends of the left and right belts are respectively connected to the left and right side plates at the junctions between the upper and lower plate bodies, whereby when the rotating shaft rotates to simultaneously wind the left and right belts around the rotating shaft, medial portions of the left and right side plates are simultaneously pulled inwards and folded.

3. The folding container as set forth in claim 1, wherein the rotating shaft of the side plate folding means comprises a rotating shaft rotatably installed at a central portion of a bottom in the container body in the longitudinal direction of the container body, wherein first ends of left and right belts are wound around the rotating shaft in opposite directions, and second ends of the left and right belts are respectively connected to the left and right side plates at the junctions between the upper and lower plate bodies, whereby when the rotating shaft rotates to simultaneously wind the left and right belts around the rotating shaft, medial portions of the left and right side plates are simultaneously pulled inwards and folded.

4. The folding container as set forth in claim 1, wherein the rotating shaft of the side plate folding means comprises rotating shafts respectively and rotatably installed at both sides of an upper or lower portion in the container body in the longitudinal direction of the container body, wherein first ends of left and right belts are respectively connected to the rotating shafts, and each of second ends of the left and right belts is connected to an opposite one of the left and right side plates at the junction between the upper and lower plate bodies of the corresponding side plate in such a way that the left and right belts form an "X" shape, whereby when the rotating shafts rotate to wind the left and right belts around the corresponding rotating shafts, medial portions of the left and right side plates are pulled inwards and folded.

5. The folding container as set forth in claim 1, wherein the rotating shaft of the side plate folding means comprises rotating shafts respectively and rotatably installed at upper or lower portions of both sidewalls in the container body in the longitudinal direction of the container body, wherein first ends of left and right belts are connected to the respective rotating shafts, and each of second ends of the left and right belts is connected to an opposite one of the left and right side plates at the junction between the upper and lower plate bodies of the corresponding side plate in such a way that the left and right belts form an "X" shape, whereby when the rotating shafts rotate to wind the left and right belts around the corresponding rotating shafts, medial portions of the left and right side plates are pulled inwards and folded.

6. The folding container as set forth in claim 2, wherein a spool is fitted over and fastened to the rotating shaft by a key so that the belt is wound around the spool.

7. The folding container as set forth in claim 2, wherein a polygonal protrusion is provided on an end of the rotating shaft and is inserted into a through hole formed in the container body such that the polygonal protrusion extends outside the container body through the through hole, wherein a ratchet handle having a wrench hole is connected to the rotating shaft in such a way that the polygonal protrusion is inserted into the wrench hole so that the rotating shaft is able to be rotated by rotating the ratchet handle outside the container body.

8. The folding container as set forth in claim 2, wherein a reverse U-shaped hook is connected to the second end of the belt, and a catch rod is provided in the corresponding side plate at a position adjacent to the junction between the upper and lower plate bodies of the side plate so that the reverse U-shaped hook of the belt is removably hooked to the catch rod.

9. The folding container as set forth in claim 1, wherein each of the spring hinges comprises upper and lower mounting pieces rotatably coupled to each other by a shaft pin over which at least one torsion coil spring is fitted, wherein guide depressions are respectively formed in outer surfaces of the mounting pieces in such a way as to face each other so that opposite legs of the torsion coil spring are seated into and guided by the guide depressions to prevent the legs from protruding outside the mounting pieces when the legs are moved in an axial direction by torsion of the torsion coil spring.

10. The folding container as set forth in claim 9, wherein each of the spring hinges is configured such that a number of torsion coil springs is different depending on a load applied to the spring hinge, wherein a number of torsion springs of each of the spring hinges that rotate up to 180° and are installed between the upper and lower plate bodies of the left and right side plates is greater than a number of torsion springs of each of the springs hinges that rotate up to 90° and which are installed between the top plate and the upper plate bodies of the left and right side plates and between the bottom plate and the lower plate bodies of the left and right side plates.

11. The folding container as set forth in claim 9, wherein each of the spring hinges is configured such that a number of turns of a wire of each torsion coil spring is changed depending on a load applied to the spring hinge, wherein a number of turns of the wire of each torsion coil spring of the spring hinges that rotate up to 180° and which are installed between the upper and lower plate bodies of the left and right side plates is greater than a number of turns of each torsion coil spring of the springs hinges that rotate up to 90° and which are installed between the top plate and the upper plate bodies of the left and right side plates and between the bottom plate and the lower plate bodies of the left and right side plates.

12. The folding container as set forth in claim 9, wherein the wire of each torsion coil spring of the spring hinges is configured such that a cross-section thereof has an elliptical shape that has a vertical major axis and is reduced in a diameter with respect to a longitudinal direction of the torsion coil spring so that the spring hinge is compact in the longitudinal direction of the torsion coil spring.

13. The folding container as set forth in claim 1, further comprising:

a plurality of side plate support units, each of the side plate support units comprising: a connection bracket provided on each of front and rear ends of the junctions between the top plate and the upper plate bodies of the left and right side plates, between the upper and lower plate bodies of the left and right side plates, and between the bottom plate and the lower plate bodies of the left and right side plates, the connection bracket being fastened at a first end thereof to one of the associated pair of elements; and a fastening bar installed in a remaining one of the associated pair of elements, the fastening bar being elastically and removably inserted into a support hole formed in a second end of the connection bracket, wherein the fastening bar is installed in a bar housing, having a guide slot extending in a longitudinal direction of the bar housing, and a locking slot extending from a rear end of the guide slot in a circumferential direction, and a protrusion handle is provided on a predetermined portion of the fastening bar and elastically moves along the guide slot or the locking slot so that the fastening bar is inserted into the support hole of the connection bracket to support the connection bracket and to prevent the left and right side plates from being folded or is removed from the support hole to release the connection bracket.

14. The folding container as set forth in claim 13, further comprising:

a plurality of holding bars provided on the front and rear ends of the bottom plate below the corresponding connection brackets, each of the holding bars having: a hinge pin provided on an upper portion of the holding bar so that the holding bar rotates around the hinge pin and is elastically extracted from or retracted into the bottom plate; and a fastening pin protruding inwards from a lower end of the holding bar so that when the container body is folded, the fastening pin is inserted into the support hole of the connection bracket fastened to the top plate to maintain the container body in the folded state.

15. The folding container as set forth in claim 1, wherein, of the catch clamps disposed on the lower ends of the left and right side plates of the container body, the clamp part of each of at least catch clamps that are disposed at opposite ends of the left and right side plates comprises a double locking hook comprising first and second locking hooks rotatably connected to each other by a connection ring, the first and second locking hooks being selectively locked to the latch that is provided on the lower plate body of the corresponding side plate or locked to the latch that is provided on the top plate when the container body is folded, wherein the first locking hook of the double locking hook is elastically biased upwards by a torsion spring to prevent the double locking hook from hanging down and making contact with a ground, and a support pin is retractably extracted from one side of the clamp part to restrict the elastic upward rotation of the double locking hook so that the double locking hook is prevented from coming into contact with a lower portion of the corresponding latch of the side plate, thus preventing folding of the side plate onto the bottom plate from being impeded.

16. The folding container as set forth in claim 1, wherein, of the catch clamps disposed on the lower ends of the left and right side plates of the container body, the clamp part of each of at least catch clamps that are disposed at opposite ends of the left and right side plates comprises upper and lower locking hooks connected at opposite ends thereof to each other by coil springs, the locking hooks being connected to each other in such a way that the opposite ends thereof pass through the corresponding coil springs and are locked to the corresponding opposite ends of the coil springs, whereby, when a first one of the left and right side plates is unfolded after a second one of the left and right side plates has been vertically unfolded, the coil springs elastically support the unfolded second side plate such that the second side plate is prevented from bending towards the first side plate at a junction between the second side plate and the bottom plate.

17. The folding container as set forth in claim 1, wherein a seating groove is formed in a perimeter of each of contact surfaces between the top plate, the upper and lower plate bodies of the left and right side plates and the bottom plate, and a silicone packing is seated into the seating groove to ensure a seal therebetween.

18. The folding container as set forth in claim 1, wherein a door is provided in the medial portion of each of the left and right side plates of the container body and is rotated around a hinge provided on one side of the door to open and close it.

19. The folding container as set forth in claim 1, wherein a guide surface having an entrance ramp at an outer side thereof is formed on each of opposite ends of inner surfaces of the front and rear end plates so that when vehicles are loaded into the container body, the vehicles enter the container body along the guide surfaces.

* * * * *